US011009310B1

(12) United States Patent
Shaffer et al.

(10) Patent No.: US 11,009,310 B1
(45) Date of Patent: May 18, 2021

(54) RESET MECHANISM FOR A CROSSBOW

(71) Applicant: Hunter's Manufacturing Company, Inc. d/b/a TenPoint Crossbow Technologies, Suffield, OH (US)

(72) Inventors: Michael Shaffer, Mogadore, OH (US); Richard Bednar, Munroe Falls, OH (US); Steven Bednar, Copley, OH (US); Phillip Bednar, Copley, OH (US); Eric VanKeulen, North Canton, OH (US); Gary Smith, Jr., East Canton, OH (US); Robert Seymour, Ravenna, OH (US); Keith Bartels, Akron, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

(21) Appl. No.: 16/745,876

(22) Filed: Jan. 17, 2020

Related U.S. Application Data

(60) Provisional application No. 62/949,294, filed on Dec. 17, 2019.

(51) Int. Cl.
*F41B 5/12* (2006.01)
*F41B 5/14* (2006.01)

(52) U.S. Cl.
CPC ..... *F41B 5/1469* (2013.01); *F41B 5/123* (2013.01)

(58) Field of Classification Search
CPC ..... F41B 5/12; F41B 5/123; F41B 5/1469
USPC ..... 124/25, 35.2, 40
See application file for complete search history.

(56) References Cited

U.S. PATENT DOCUMENTS 4,699,117 A * 10/1987 Waiser ..... F41B 5/12 124/25
5,220,906 A * 6/1993 Choma ..... F41B 5/12 124/25
6,205,990 B1 * 3/2001 Adkins ..... F41B 5/1469 124/25
6,913,007 B2 * 7/2005 Bednar ..... F41B 5/123 124/25
7,174,884 B2 * 2/2007 Kempf ..... F41B 5/105 124/25
7,748,370 B1 * 7/2010 Choma ..... F41B 5/1469 124/25
7,810,480 B2 * 10/2010 Shepley ..... F41A 11/02 124/25
8,091,540 B2 * 1/2012 Matasic ..... F41B 5/12 124/31
8,240,299 B2 * 8/2012 Kronengold ..... F41A 11/02 124/25
8,375,928 B1 * 2/2013 Bednar ..... F41B 5/1469 124/25
8,752,535 B2 6/2014 Barber et al.
9,303,944 B2 4/2016 Barber
9,341,432 B1 * 5/2016 Wohleb ..... F16H 25/20
9,383,159 B2 7/2016 Pulkrabek et al.
9,435,605 B2 * 9/2016 McPherson ..... F41B 5/12
9,494,379 B2 * 11/2016 Yehle ..... F41B 5/066
9,494,381 B1 * 11/2016 Jeske ..... F41B 5/1469
9,797,674 B2 10/2017 Barber
(Continued)

*Primary Examiner* — Alexander R Niconovich
(74) *Attorney, Agent, or Firm* — Emerson Thomson Bennett, LLC

(57) ABSTRACT

A crossbow reset mechanism may be used to reset a safety activator and a de-cock activator. The reset mechanism may reset the safety and de-cock activators simultaneously.

17 Claims, 32 Drawing Sheets

(56) References Cited

U.S. PATENT DOCUMENTS

| | | | | |
|---|---|---|---|---|
| 9,879,936 | B2 | 1/2018 | Yehle | |
| 9,945,646 | B2 | 4/2018 | Barnett | |
| 9,958,232 | B1 * | 5/2018 | Egerdee | F41B 5/1403 |
| 10,041,755 | B1 * | 8/2018 | Langdon | F41B 5/148 |
| 10,077,965 | B2 * | 9/2018 | Yehle | F41B 5/123 |
| 10,082,359 | B2 * | 9/2018 | Yehle | F41B 5/10 |
| 10,126,088 | B2 | 11/2018 | Yehle | |
| 10,175,023 | B2 * | 1/2019 | Yehle | F41B 5/123 |
| 10,254,073 | B2 | 4/2019 | Yehle | |
| 10,458,743 | B1 * | 10/2019 | Kempf | F41B 5/123 |
| 10,605,555 | B1 * | 3/2020 | Shaffer | F41A 19/10 |
| 10,866,055 | B1 * | 12/2020 | Hensel | F41B 5/12 |
| 2010/0170488 | A1 * | 7/2010 | Rasor | F41A 19/12 124/25 |
| 2010/0269807 | A1 * | 10/2010 | Kempf | F41B 5/12 124/25 |
| 2012/0152220 | A1 * | 6/2012 | Barber | F41B 5/1469 124/35.1 |
| 2014/0261360 | A1 * | 9/2014 | Pulkrabek | F41B 5/1469 124/35.2 |
| 2014/0305417 | A1 * | 10/2014 | Barber | F41B 5/12 124/25 |
| 2015/0000646 | A1 | 1/2015 | Schley | |
| 2017/0131059 | A1 * | 5/2017 | McPherson | F41B 5/123 |
| 2019/0154392 | A1 | 5/2019 | Yehle | |

* cited by examiner

RESET MECHANISM FOR A CROSSBOW

This application claims priority to U.S. Provisional Patent Application No. 62/949,294, titled De-Cock Mechanism For A Crossbow, filed Dec. 17, 2019, which is incorporated herein by reference.

I. BACKGROUND

A. Field of the Invention

This invention generally relates to methods and apparatuses related to crossbows and more specifically to methods and apparatuses related to resetting crossbow components.

B. Description of Related Art

Crossbows have been used for many years as a weapon for hunting and fishing, and for target shooting. In general, a crossbow includes a main beam and a bow mechanism supported to the main beam. The bow mechanism may have a pair of bow limbs and a bowstring engaged to the bow limbs. Often the bow mechanism has wheels on the bow limbs that receive the bowstring but this is not always the case. A trigger mechanism may be supported to the main beam and operable to hold the bowstring and to release the bowstring to fire the crossbow to shoot an arrow or bolt. The bowstring may be movable from an un-cocked position (sometimes referred to as an undrawn position) to a cocked position where the trigger mechanism holds the bowstring (sometimes referred to as a drawn position). This is typically referred to as cocking the crossbow.

Sometimes it is desirable to adjust a crossbow bowstring from a cocked position to an un-cocked position without shooting the arrow. This is typically referred to as de-cocking the crossbow. While there are several known methods and devices for de-cocking a crossbow, it remains desirable to provide improved de-cock devices and methods. It is known to provide crossbows with safety devices. It is desirable to provide an effective yet easy way to reset safety and de-cock devices.

II. SUMMARY

According to some embodiments of this invention, a crossbow may comprise: a longitudinally extending main beam; a bow mechanism including: (1) a pair of outwardly extending bow limbs extending transversely from opposite lateral sides of the main beam; and (2) a bowstring operatively engaged to the outwardly extending bow limbs and movable from: (a) an un-cocked position; to (b) a cocked position; a trigger mechanism including a string latch movable into: (1) a first string latch position that holds the bowstring in the cocked position; (2) a second string latch position that does not hold the bowstring in the cocked position; and (3) a third string latch position, distinct from the first and second string latch positions, that is a de-cock mode position; a safety mechanism including a safety activator selectively movable from: (1) a first safety activator position that prevents the string latch from being moved into the second string latch position; into (2) a second safety activator position that permits the string latch to be moved into the second string latch position; a de-cock mechanism including a de-cock activator selectively movable from: (1) a first de-cock activator position that prevents the string latch from being moved into the third string latch position; into (2) a second de-cock activator position that permits the string latch to be moved into the third string latch position; and a reset mechanism including a reset activator that is selectively movable from: (1) a first reset activator position; into (2) a second reset activator position to: (a) move the safety activator from the second safety activator position to the first safety activator position; and (b) move the de-cock activator from the second de-cock activator position to the first de-cock activator position.

According to some embodiments of this invention, a crossbow method may comprise the steps of: A) providing a crossbow comprising: a longitudinally extending main beam; a bow mechanism including: (1) a pair of outwardly extending bow limbs extending transversely from opposite lateral sides of the main beam; and (2) a bowstring operatively engaged to the outwardly extending bow limbs; a trigger mechanism including a string latch; a safety mechanism including a safety activator; a de-cock mechanism including a de-cock activator; and a reset mechanism including a reset activator; B) providing the bowstring to be operable to perform the step of: moving between: (a) an un-cocked position; and (b) a cocked position; C) providing the string latch to be operable to perform the step of: moving into: (1) a first string latch position that holds the bowstring in the cocked position; (2) a second string latch position that does not hold the bowstring in the cocked position; and (3) a third string latch position, distinct from the first and second string latch positions, that is a de-cock mode position; D) providing the safety activator to be operable to perform the step of: moving from: (1) a first safety activator position that prevents the string latch from being moved into the second string latch position; into (2) a second safety activator position that permits the string latch to be moved into the second string latch position; E) providing the de-cock activator to be operable to perform the step of: moving from: (1) a first de-cock activator position that prevents the string latch from being moved into the third string latch position; into (2) a second de-cock activator position that permits the string latch to be moved into the third string latch position; and F) providing the reset activator to be operable to perform the step of: moving from: (1) a first reset activator position; into (2) a second reset activator position to: (a) move the safety activator from the second safety activator position to the first safety activator position; and (b) move the de-cock activator from the second de-cock activator position to the first de-cock activator position.

III. BRIEF DESCRIPTION OF THE DRAWINGS

The present subject matter may take physical form in certain parts and arrangement of parts, embodiments of which will be described in detail in this specification and illustrated in the accompanying drawings which form a part hereof and wherein.

IV. DETAILED DESCRIPTION

Figure 1:
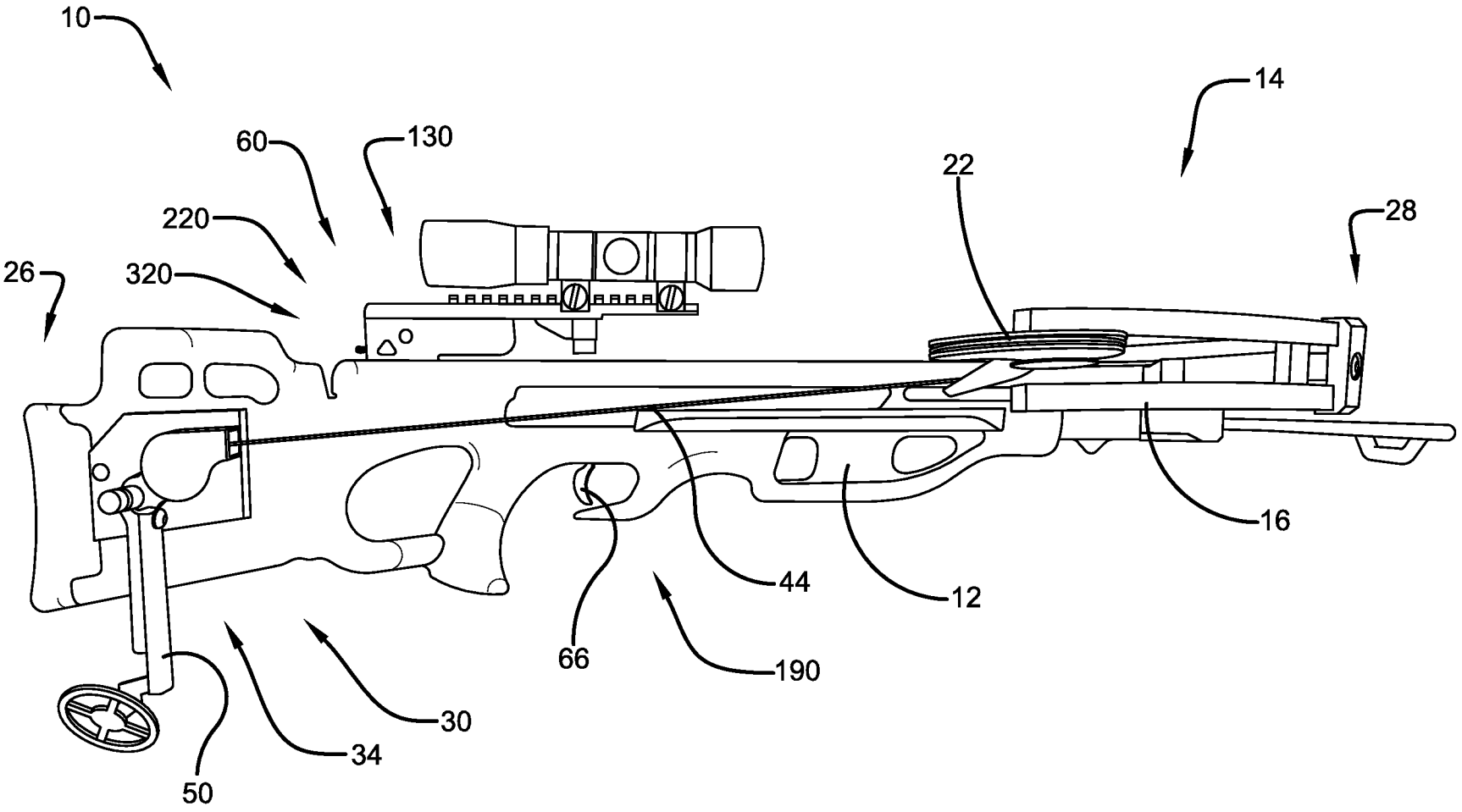
FIG. 1 is a right side view of a crossbow that may have de-cocking capabilities according to some embodiments of this invention.
Figure 2:
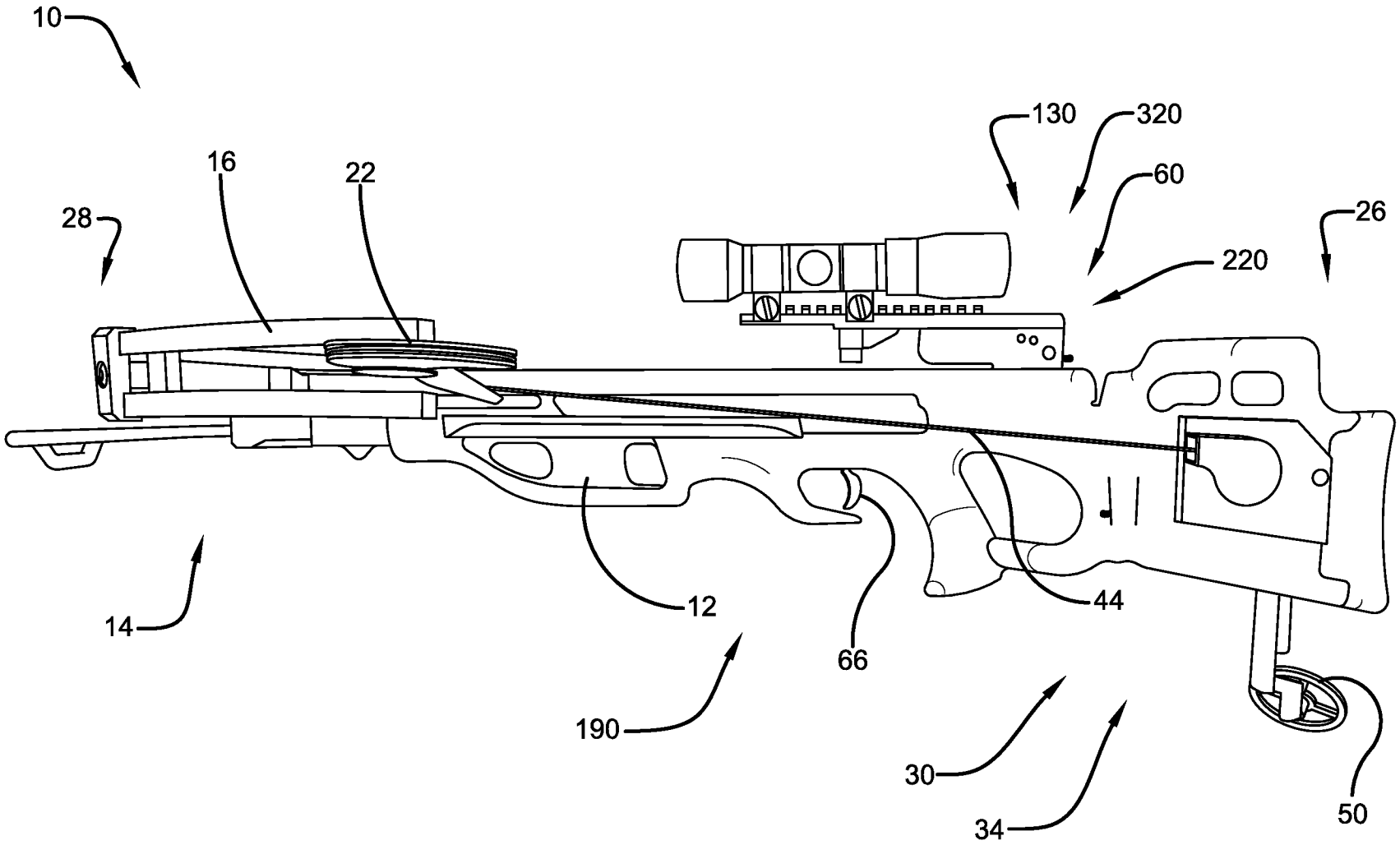
FIG. 2 is a left side view of the crossbow shown in FIG. 1.
Figure 3:
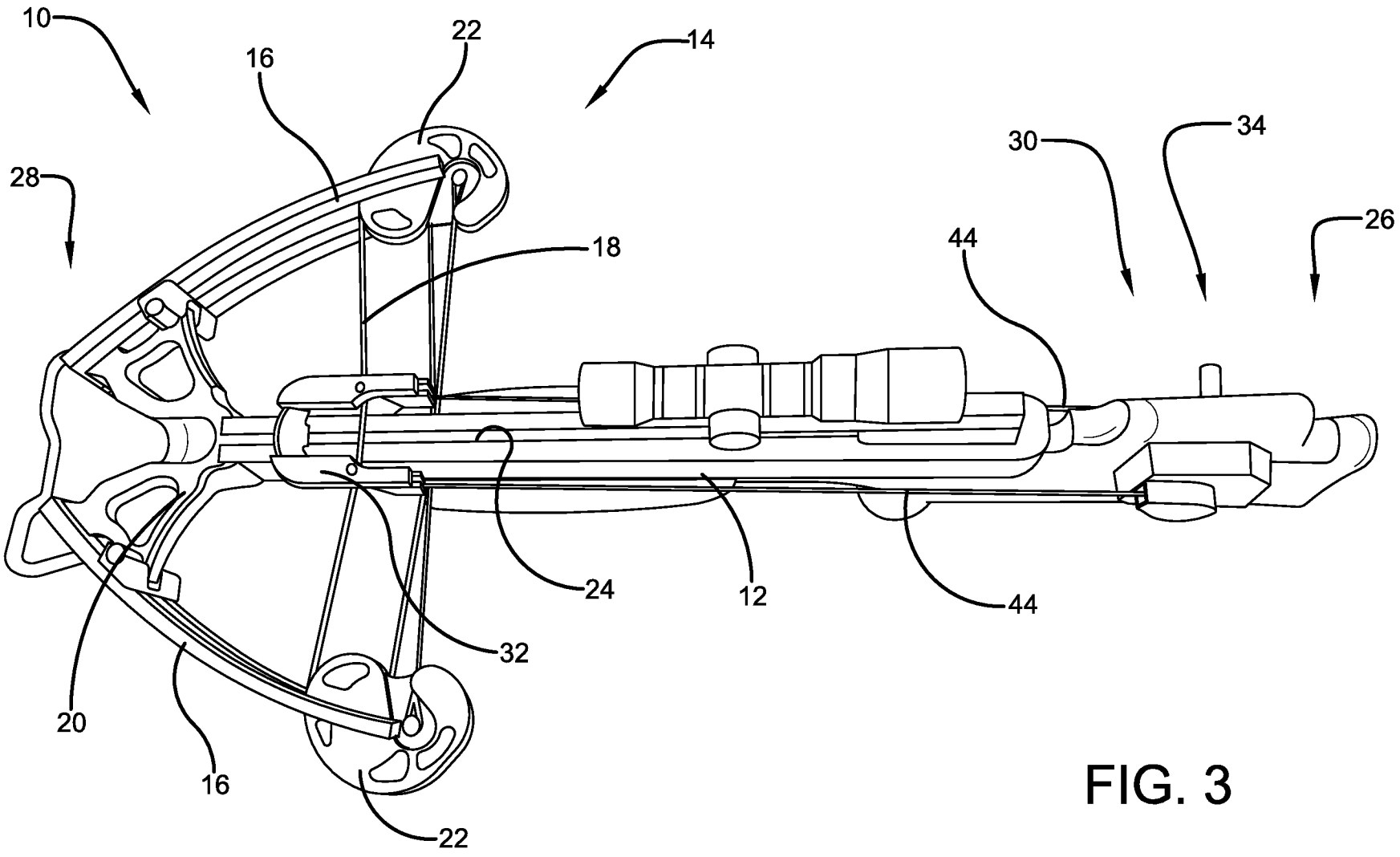
FIG. 3 is a top side view of the crossbow shown in FIG. 1.

Referring now to the drawings wherein the showings are for purposes of illustrating embodiments of the present subject matter only and not for purposes of limiting the same, and wherein like reference numerals are understood to refer to like components, FIGS. 1-3 show a crossbow 10 that may have de-cocking capabilities according to some embodiments of this invention. It should be understood that any crossbow having a bowstring that is movable from an un-cocked position to a cocked position chosen with the sound judgement of a person of skill in the art will work with embodiments of this invention. Non-limiting examples of crossbow types that work with this invention include: Recurve Crossbows, Compound Crossbows, Rifle Crossbows, and Reverse Draw Crossbows.

With continuing reference to FIGS. 1-3, the crossbow 10 may have a proximal end 26 and a distal end 28. The crossbow 10 may include a longitudinally extending main beam 12 and a bow mechanism 14 supported to the main beam 12. The upper surface of the main beam 12 may have a groove 24 (visible in FIG. 3) that receives an arrow or bolt (not shown). The bow mechanism 14 may include a pair of outwardly extending bow limbs 16, 16 extending transversely from opposite lateral sides of the main beam 12 and a bowstring 18 (visible in FIG. 3) operatively engaged to the bow limbs 16. The bowstring 18 may be movable from an un-cocked position (shown in FIGS. 1-3) to a cocked position (shown in FIGS. 4 and 8). The bow mechanism 114 may be supported directly to the main beam 112 or may be, in the embodiments shown, supported to the main beam 12 via a riser 20 (seen best in FIG. 3). In some embodiments, wheels 22, 22 (which may be pulleys, cams, or the like) may be pivotally supported to the bow limbs 16, 16, respectively, as shown. In this case, the bowstring 18 may be operatively engaged to the wheels 22, 22. As the general operation of main beams and bow mechanisms on crossbows is well known to those of skill in the art, further details will not be provided here.

With reference now to FIGS. 1-4, the crossbow 10 may include a cocking mechanism adapted to be used by an associated user to move the bowstring from the un-cocked position to the cocked position. While embodiments of a cocking mechanism are shown and will be described, it should be understood that any cocking mechanism chosen with the sound judgement of a person of skill in the art will work with embodiments of this invention. The cocking mechanism 30 shown may include a claw 32 adapted to engage the bowstring 18 and a drawing mechanism 34 adapted to move the claw 32 along the main beam 12 and thereby move the bowstring 18 from the un-cocked position (shown in FIG. 3) to the cocked position (shown in FIG. 4).

With reference now to FIGS. 1-6, the claw 32 may have a surface 36 that selectively operatively engages the bowstring 18 and a surface 38 that selectively operatively engages the main beam 12. In some embodiments, surface 38 includes a convex member 40 (see FIGS. 5 and 6) that is received in the main beam groove 24. In this way the claw 32 remains engaged with the main beam 12 as it moves longitudinally along the main beam 12. The claw 32 may have a pair of surfaces 42, 42 on opposite lateral sides that operatively receive the distal ends of a pair of cocking cable segments 44, 44, respectively, as shown. In some embodiments, the cocking cable segments 44, 44 are part of a single cable that is received in a cable channel 46 formed in the claw 32 that extends within the claw 32 from one lateral side to the other. In some embodiments, shown, surfaces 42, 42 include rotatable pulleys.

With reference now to FIGS. 1-4, the drawing mechanism 34 may be supported to the main beam 12 and may receive the proximal ends of the cocking cable segments 44, 44, as shown. In some embodiments, the drawing mechanism 34 may have reels (not visible) on opposite lateral sides of the main beam to receive the cable segments 44, 44. A manually rotatable handle 50 may use rotational power input to cause the reels to rotate to draw the claw 32 proximally to move the bowstring 18 into the cocked position. Because the bowstring 18 applies a distal force to the claw 32, the handle 50 may also be used, when rotated in the opposite direction, to permit the claw 32 to move distally to move the bowstring 18 into the un-cocked position. In some embodiments, the drawing mechanism 34 is adapted to prevent motion of the claw 32 along the main beam 18 unless the user is rotating the handle 50 accordingly. In this way, should the user release the handle 50, the claw 32 (and thus the bowstring 18) will remain in the same position relative to the main beam 12. In some embodiments, the handle 50 may be selectively removable when not needed. As the general operation of cocking mechanisms is well known to those of skill in the art, further details will not be provided here.

With reference now to FIGS. 1-2, 4 and 7-13, the crossbow 10 may have a trigger mechanism 60 selectively operable to release the bowstring 18 from the cocked position so that the bowstring 18 can shoot the arrow and return to the un-cocked position. The trigger mechanism 60 may include a string latch 62, a trigger link 64, a trigger 66 and one or more trigger interconnecting members that operatively interconnect the trigger 66 with the trigger link 64. These components will be discussed in turn.

With reference now to FIGS. 7-15, the string latch 62 may be positioned within a housing 70 and may have a pair of downwardly extending fingers 76, 76 on opposite lateral sides of the string latch 62. The string latch 62 may be moveable between a first string latch position that holds the bowstring 18 in the cocked position (shown in FIG. 8) and a second string latch position that does not hold the bowstring 18 in the cocked position (shown in FIG. 11). The bowstring 18 may be held in the cocked position by the fingers 76, 76 of the string latch 62. The second string latch position may be achieved by moving the fingers 76, 76 out of the way permitting the bowstring 18 to move distally (to the right in FIG. 8). In some embodiments, the string latch 62 is moved from the first string latch position to the second string latch position by pivoting the string latch 62 in direction 78 (see FIG. 8). The string latch 62 may, for example, have an opening 80 that receives a pivot pin 82, supported to the housing 70, about which the string latch 62 pivots. A string latch biasing device 84, such as a spring, may be used to apply a biasing force to bias the string latch 62 into the second string latch position. For the embodiments shown, the string latch biasing device 84 biases the string latch 62 to pivot about pivot pin 82 in direction 78. The string latch 62 may have a surface 68 (see FIG. 15) that operatively engages surface 88 on the housing 70 (see FIG. 9) when the string latch 62 moves into the second string latch position. In some embodiments, shown, surface 68 is planar and surface 88 is convex curved. In some embodiments, surface 88 is composed at least in part of an elastic material to absorb vibrations and extend wear. The string latch 62 may be moveable into a third string latch position that is a de-cock mode position (shown in FIG. 12). In some embodiments, the string latch 62 is moved from the first string latch position to the third string latch position by pivoting the string latch 62 in direction 86.

With reference now to FIGS. 7-14 and 16-17, the trigger link 64 may be positioned within the housing 70 and may be movable between a first trigger link position (shown in FIGS. 7-10) that retains the string latch 62 in the first string latch position and a second trigger link position (shown in FIG. 11) that does not retain the string latch 62 in the first string latch position. In some embodiments, when the string latch 62 is in the first string latch position, surface 72 of the string latch 62 (see FIG. 14) operatively engages surface 90 of the trigger link 64 (see FIG. 16). In some embodiments, shown, surface 72 is convex curved and surface 90 is concave curved and facing upward. As a result, surface 72 is retained in surface 90 and the string latch 62 is retained in the first string latch position. The second trigger link position that does not retain the string latch 62 in the first string latch position may be achieved by moving surface 72 of the string latch 62 off surface 90 of the trigger link 64. In some embodiments, the trigger link 64 is moved from the first trigger link position to the second trigger link position by pivoting the trigger link 64 in direction 110 (see FIG. 8). The trigger link 64 may, for example, have an opening 102 that receives a pivot pin 104, supported to the housing 70, about which the trigger link 64 pivots. A trigger link biasing device 112, such as a spring, may be used to apply a biasing force to bias the trigger link 64 into the first trigger link position. For the embodiment shown, the trigger link biasing device 112 biases the trigger link 64 to pivot about pivot pin 104 in direction 114. When surface 72 of the string latch 62 is moved off surface 90 of the trigger link 64, surface 72 of the string latch 62 may operatively engage surface 92 of the trigger link 64. For the embodiment shown, surface 92 is slightly concave curved so that surface 72 slides along surface 92 as the string latch 62 pivots in direction 78 into the second string latch position.

Figure 4:
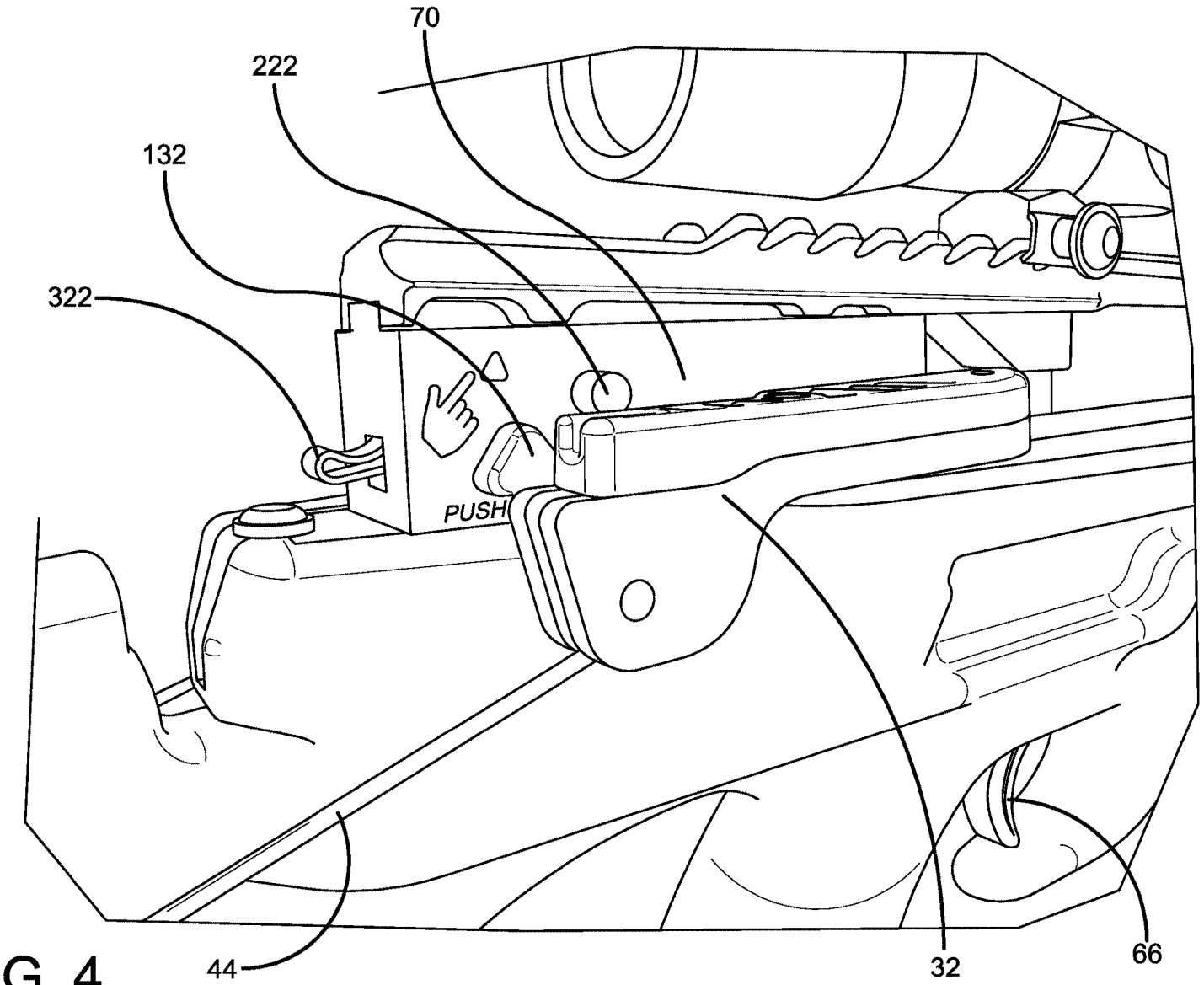
FIG. 4 is a close-up side view of a crossbow with the bowstring in the cocked position.
Figure 6:
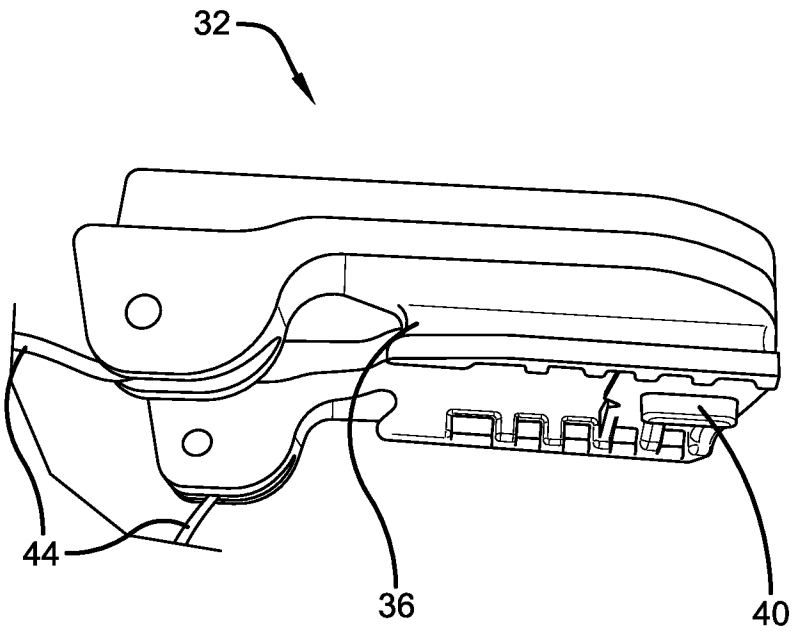
FIG. 6 is a right side view of the claw shown in FIG. 5.
Figure 5:
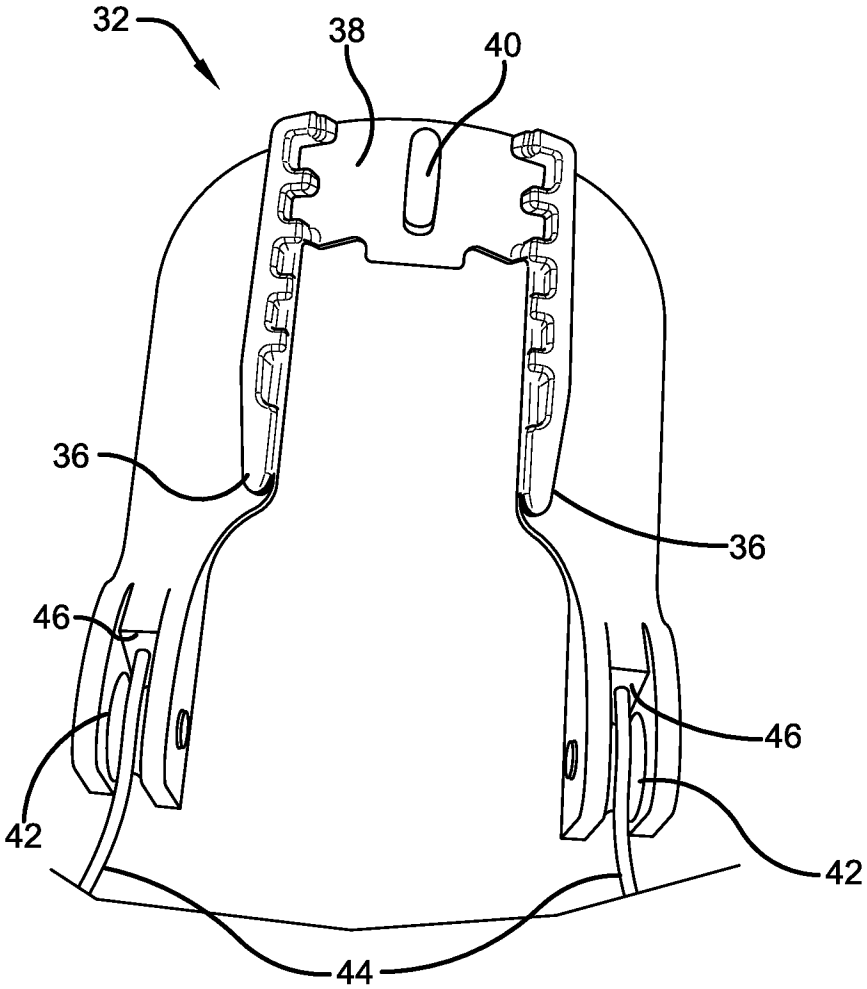
FIG. 5 is a bottom view of a claw.
Figure 7:
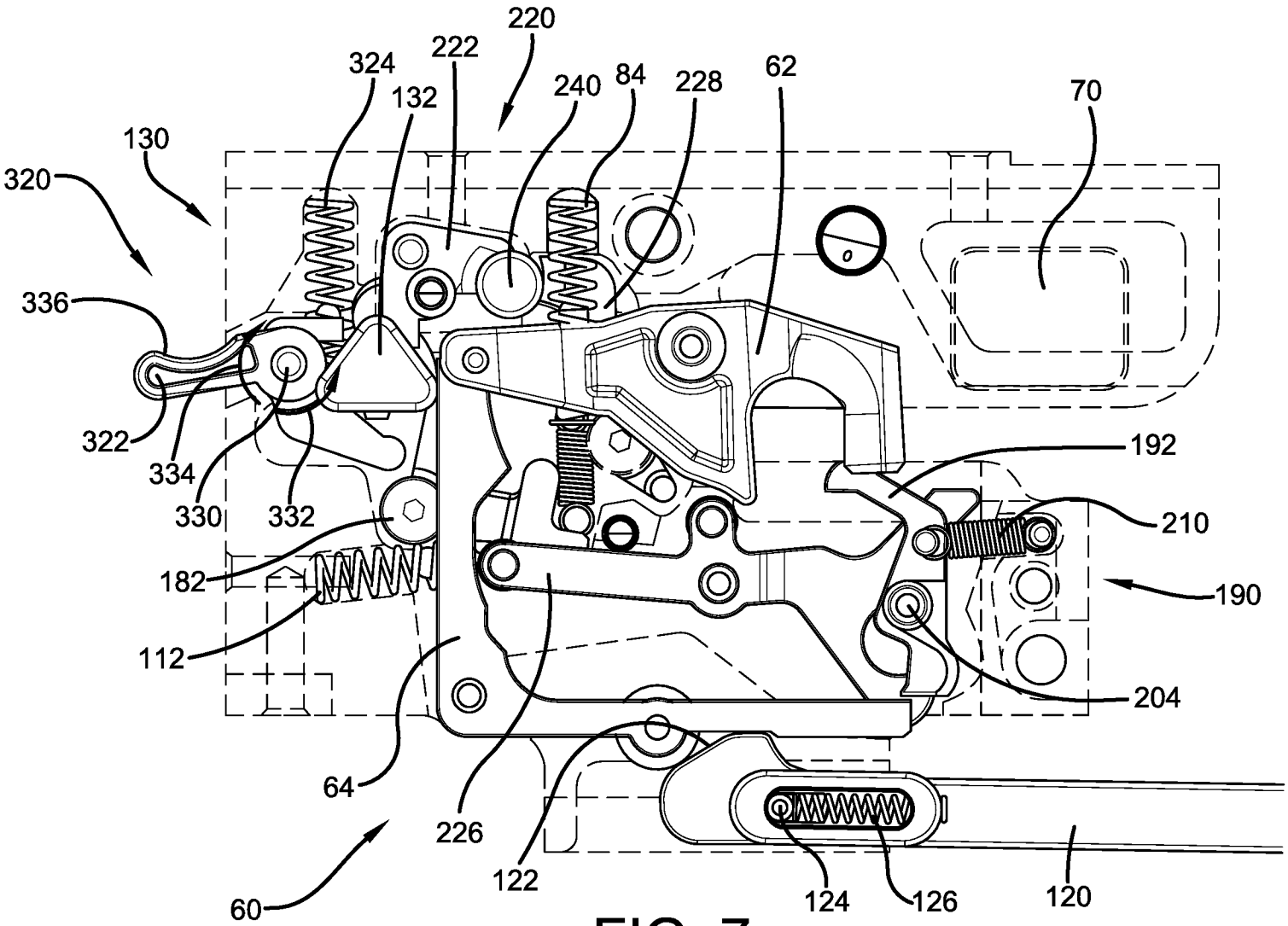
FIG. 7 is a right side view inside a housing showing a trigger mechanism, a de-cock mechanism, a dry-fire inhibitor mechanism, a safety mechanism and a reset mechanism.

With reference now to FIGS. 1-2, 4, 7-10, and 16-17 the trigger 66, shown in FIGS. 1, 2 and 4, may be operated in a known manner along with one or more trigger interconnecting members to fire the crossbow 10. The design and operation of the one or more trigger interconnecting members can be any chosen with the sound judgement of a person of skill in the art. In some embodiments, the one or more trigger interconnecting members comprise a fire link 120. Fire link 120 may have a distal end operatively connected to the trigger 66 and a proximal end operatively connected to the trigger link 64. The proximal end of the fire link 120 may have surface 122 (shown in FIG. 7) that selectively operatively engages surface 98 of the trigger link 64 (shown in FIGS. 16-17). In some embodiments, shown, surface 98 is convex curved. In some embodiments, the proximal end of the fire link 120 is pivotal about pivot pin 124 and a fire link biasing device 126, such as a spring, may be used to apply a biasing force to bias the fire link 120 distally. As the general operation of triggers and trigger interconnecting members is well known to those of skill in the art, further details will not be provided here.

With reference now to FIGS. 1-2, 4, 7 and 9-11, the crossbow 10 may include a safety mechanism 130 that prevents the crossbow 10 from being fired until the user manually adjusts the safety mechanism 130. The safety mechanism 130 may include a safety activator 132, a safety activator biasing device 134, a safety lock 136 and a safety lock biasing device 138. These components will be discussed in turn.

Figure 18:
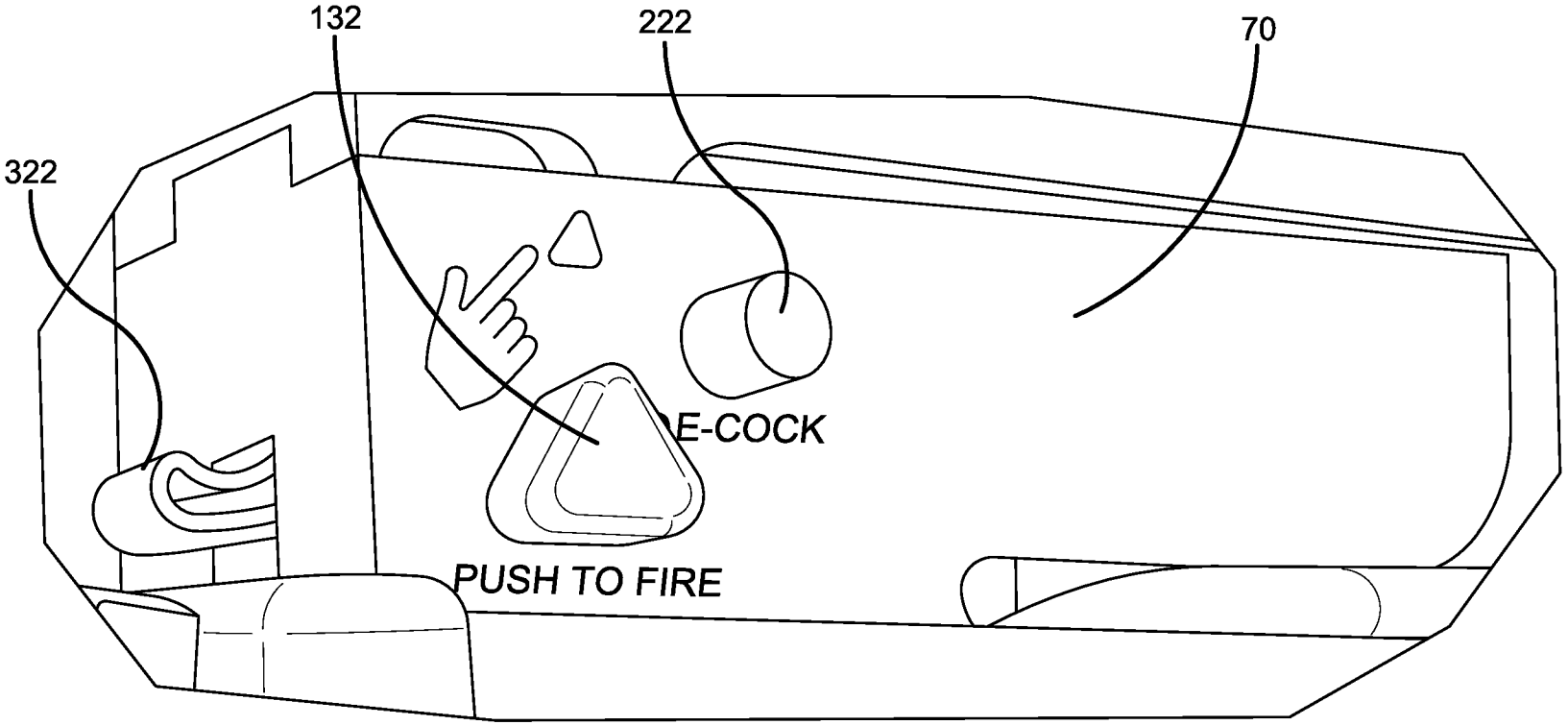
FIG. 18 is a right side perspective view of a housing showing a safety actuator in a first safety actuator position, a de-cock actuator in a first de-cock actuator position and a reset actuator in a first reset actuator position.
Figure 19:
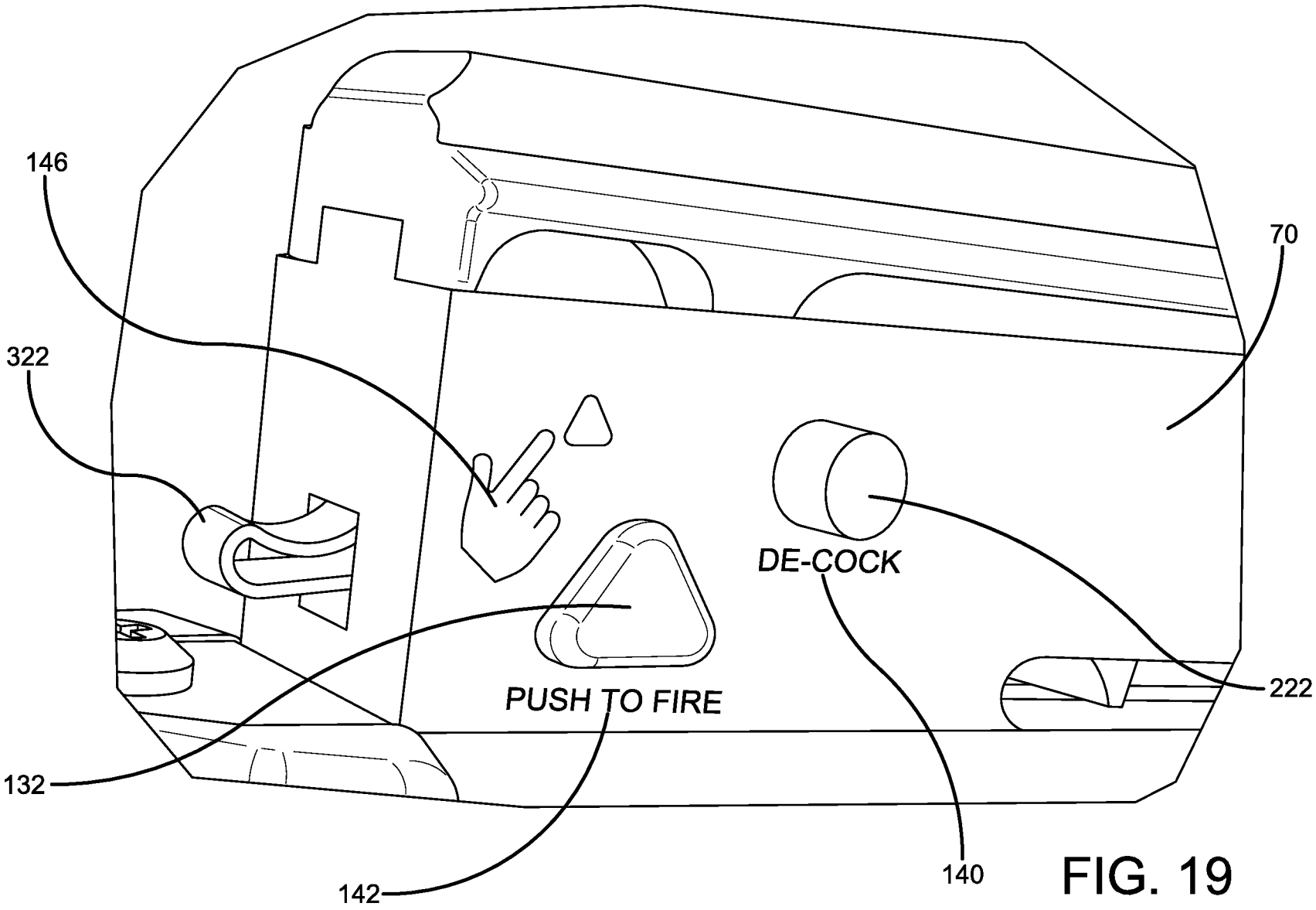
FIG. 19 is a view similar to FIG. 18 but showing the safety actuator in a second safety actuator position.
Figure 20:
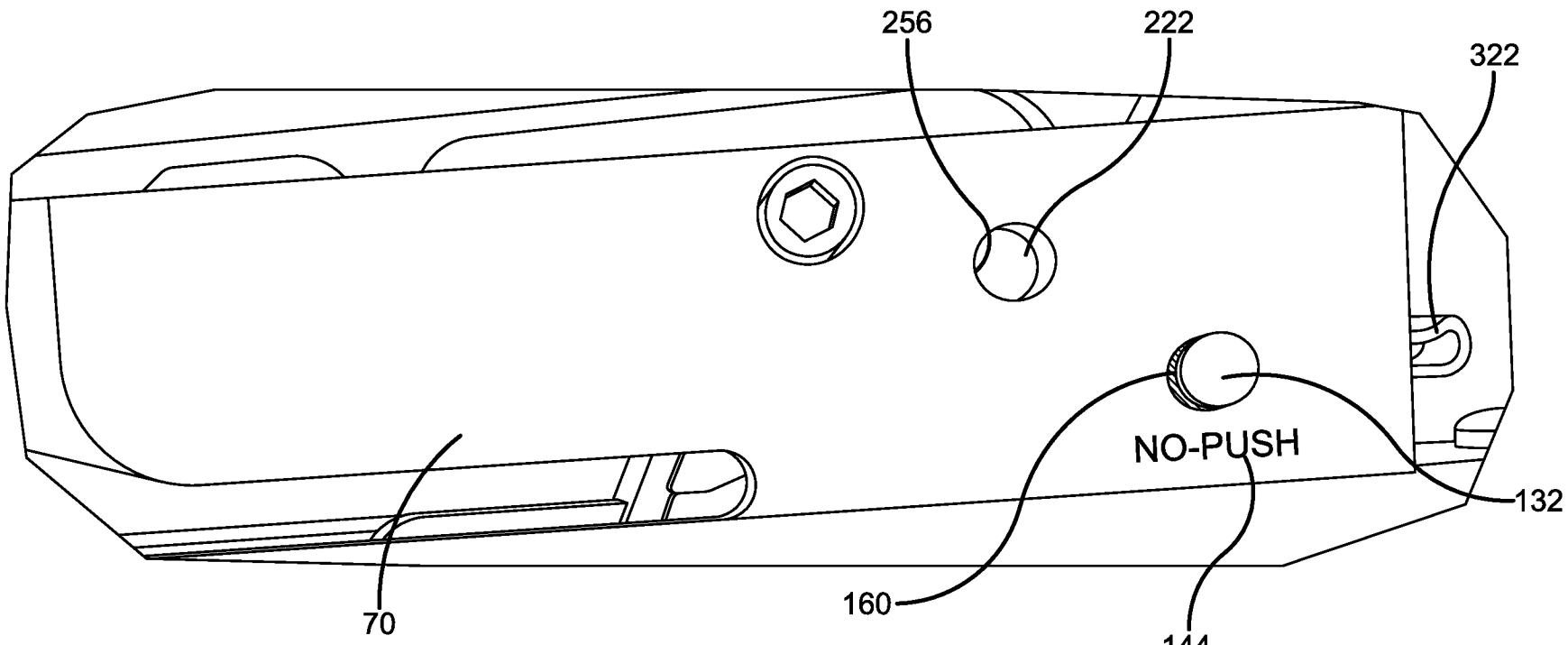
FIG. 20 is a left side view of the housing shown in FIG. 19.

With reference now to FIGS. 7, 9-11, 18-20 and 22-23, the safety activator 132 may be positioned within the housing 70 and may be selectively movable by the user from a first safety activator position (shown in FIGS. 9-10, and 18) that prevents the string latch 62 from being moved into the second string latch position (thereby preventing release of the bowstring 18 out of the cocked position) into a second safety activator position (shown in FIGS. 11 and 19-20) that permits the string latch 62 to be moved into the second string latch position (thereby permitting the crossbow 10 to be fired if all other requirements are met). The safety activator 132 may include a surface 150 for use by a user to manually move the safety activator from the first safety activator position into the second safety activator position. In some embodiments, when the safety activator 132 is in the first safety activator position, surface 150 extends outward through a housing opening outside of the housing 70 as shown in FIG. 18. To move the safety activator 132 into the second safety activator position, the user may push surface 150 moving the safety activator 132 inward with the result shown in FIG. 19. In this case, the safety activator 132 may move linearly. In some embodiments, surface 150 is positioned on one end of the safety activator 132 and the opposite end of the safety activator has a surface 160 that indicates to the user that the safety activator 132 is in the second safety activator position. Surface 160 may, for example, be colored red and may selectively extend through a housing opening 180 (shown in FIG. 25) outside of the housing 70 as shown in FIG. 20. With this arrangement, when the safety activator 132 is in the first safety activator position, surface 150 extends outward outside of a first lateral side of the housing 70 but surface 160 does not extend outside of the opposite lateral side of the housing 70. However, when the safety activator 132 is in the second safety activator position, surface 150 does not extend outside of its lateral side of the housing 70 (or does only slightly) but surface 160 does. In this way, the user has two visual indications (both ends of the safety activator 132 on opposite lateral sides of the housing 70) of what position the safety activator 132 is in.

With reference now to FIGS. 7, 9-11, 16, 18-20 and 22-23, the safety activator may have a surface 152 (shown in FIG. 22) that may be used to prevent the string latch 62 from being moved into the second string latch position. In some embodiments, when the safety activator 132 is in the first safety activator position, any attempt to move the trigger link 64 from the second trigger link position into the first trigger link position (such as trying to fire the crossbow) is unsuccessful because such attempted motion would cause surface 156 of the trigger link 64 (see FIG. 16) to operatively engage surface 152 of the safety activator 132. The proximity of these surfaces is visible in FIG. 7. This engagement prevents the trigger link 64 from moving from the second trigger link position into the first trigger link position, which prevents the string latch 62 from moving from the first string latch position to the second string latch position. Thus, when the safety activator 132 is in the first safety activator position, it is not possible to fire the crossbow 10. A safety activator biasing device 134, such as a spring best seen in FIG. 10, may be used to apply a biasing force to bias the safety activator 132 into the first safety activator position. For the embodiment shown, the biasing device 134 has one end that operatively engages a surface of the housing 70 and an opposite end that operatively engages surface 162 of the safety activator 132 (see FIGS. 22-23).

With reference now to FIGS. 7-10 and 23-25, a safety lock 136 may be positioned within the housing 70 and may be movable between a first safety lock position (shown in FIGS. 10 and 24) that retains the safety activator 132 in the second safety activator position and a second safety lock position (shown in FIG. 25) that permits the safety activator 132 to move into the first safety activator position. In some embodiments, the safety lock 136 may have a surface 170 (see FIG. 24) that operatively engages surface 172 of the safety activator 132 (see FIG. 23). The engagement of these surfaces is visible in FIG. 10. In some embodiments, juxtaposed to surface 172 of the safety activator 132 may be surface 174 that extends outward from surface 172. When the safety activator 132 is in the second safety activator position and the safety lock 136 is in the first safety lock position, a side surface of the safety lock 136 near surface 170 is juxtaposed to surface 174 to retain the safety activator 132 in the second safety activator position. When the safety activator 132 is in the first safety activator position and the safety lock 136 is in the second safety lock position, surface 170 may operatively engage surface 176 of the safety activator 132 (see FIG. 23). As seen best in FIG. 23, surface 176 may have a circular cross-section. Surface 170 may have a C-shape to match the circumference of surface 172.

With reference now to FIGS. 7-10 and 24-25, in some embodiments, the safety lock 136 may be moved between the first safety lock position and the second safety lock position by pivoting the safety lock 136. The safety lock 136 may, for example, have an opening that receives a pivot pin 182, supported to the housing 70, about which the safety lock 136 pivots. A safety lock biasing device 138, such as a spring, may be used to apply a biasing force to bias the safety lock 136 into the first safety lock position. The way in which the safety lock 136 is selectively moved from the first safety lock position into the second safety lock position will be described below.

With reference now to FIGS. 1-2, 7-11 and 26-27, the crossbow 10 may include a dry-fire inhibitor mechanism 190 that prevents the crossbow 10 from being fired if an arrow is not properly positioned on the main beam 12. The dry-fire inhibitor mechanism 190 may include a dry-fire link 192 that may be positioned within the housing 70 and that may be movable between a first dry-fire link position (shown in FIGS. 7-9) that prevents the bowstring 18 from moving from the cocked position to the un-cocked position and a second dry-fire link position (shown in FIG. 11) that permits the bowstring 18 to move from the cocked position to the un-cocked position.

Figure 26:
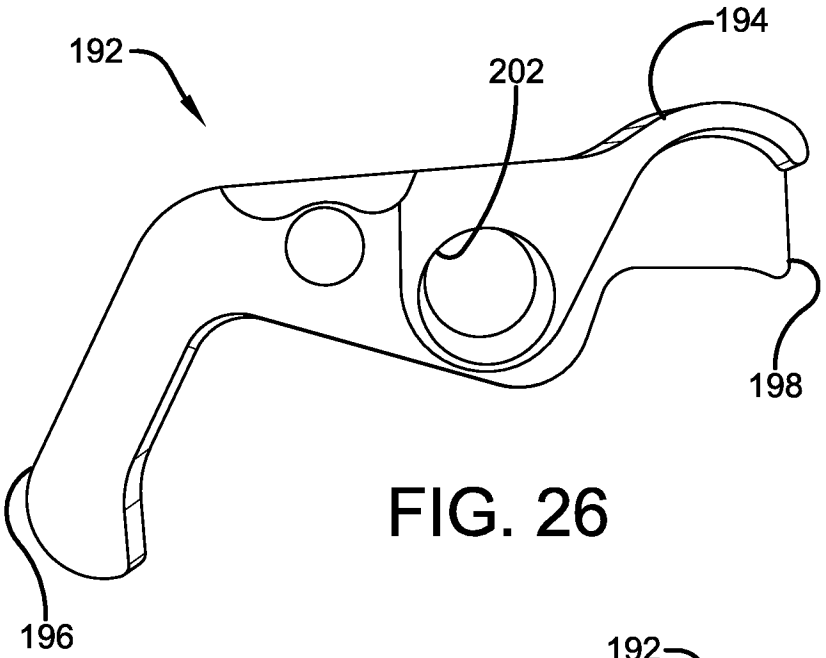
FIG. 26 is a side view of a dry-fire link.

With continuing reference to FIGS. 1-2, 7-11 and 26-27, in some embodiments, when the dry-fire link 192 is in the first dry-fire link position, any attempt to move the trigger link 64 from the second trigger link position into the first trigger link position (such as trying to fire the crossbow) is unsuccessful because such attempted motion would cause surface 100 of the trigger link 64 (see FIG. 16) to operatively engage surface 198 of the dry-fire link 192 (see FIG. 26). The proximity of these two surfaces is visible in FIGS. 7-8. In some embodiments, the dry-fire link 192 is moved between the first dry-fire link position and the second dry-fire link position by pivoting the dry-fire link 192. The dry-fire link 192 may, for example, have an opening 202 that receives a pivot pin 204, supported to the housing 70, about which the dry-fire link 192 pivots. A dry-fire link biasing device 210, such as a spring, may be used to apply a biasing force to bias the dry-fire link 192 into the into the first dry-fire link position.

Figure 8:
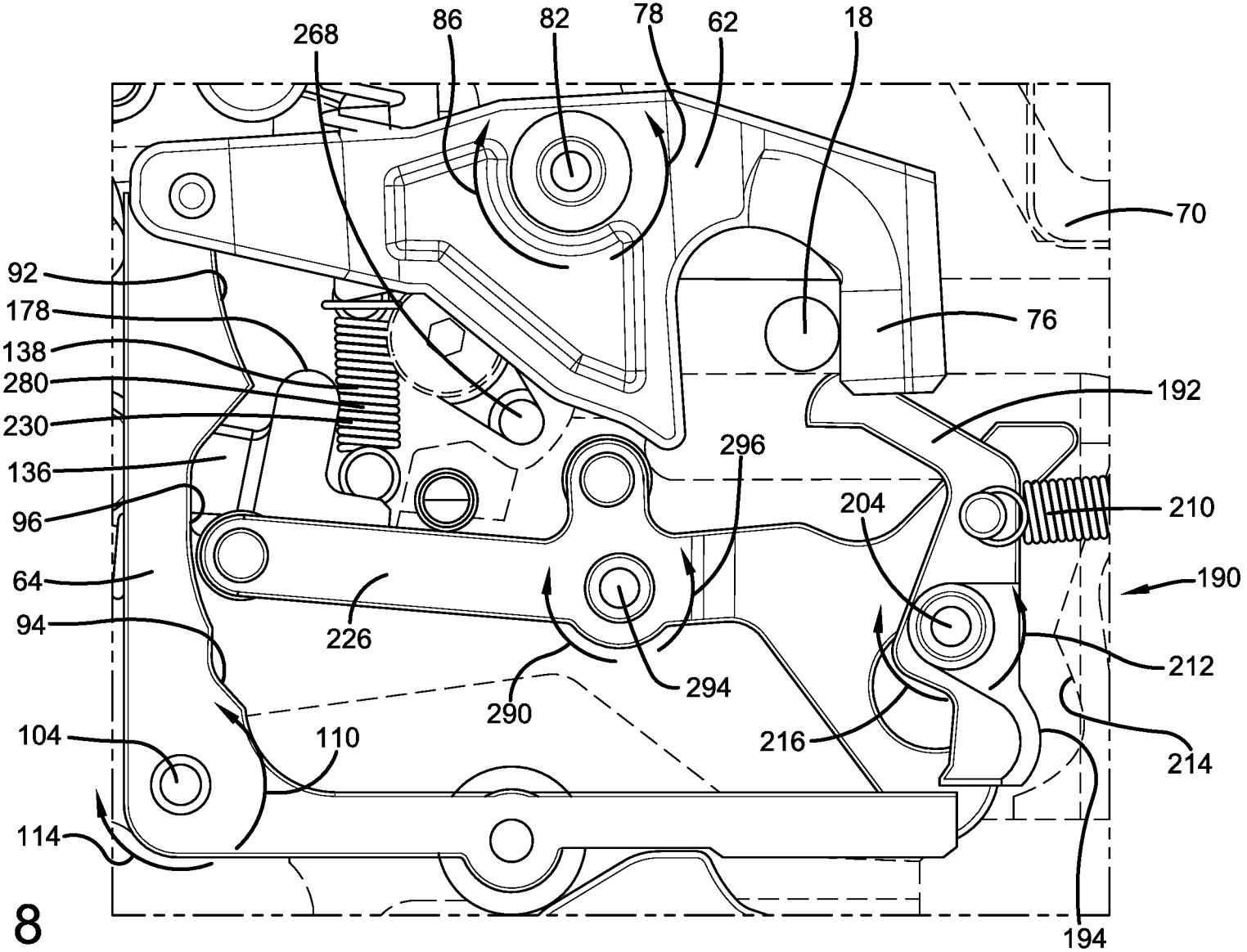
FIG. 8 is a close-up view of a portion of the components shown FIG. 7.
Figure 9:
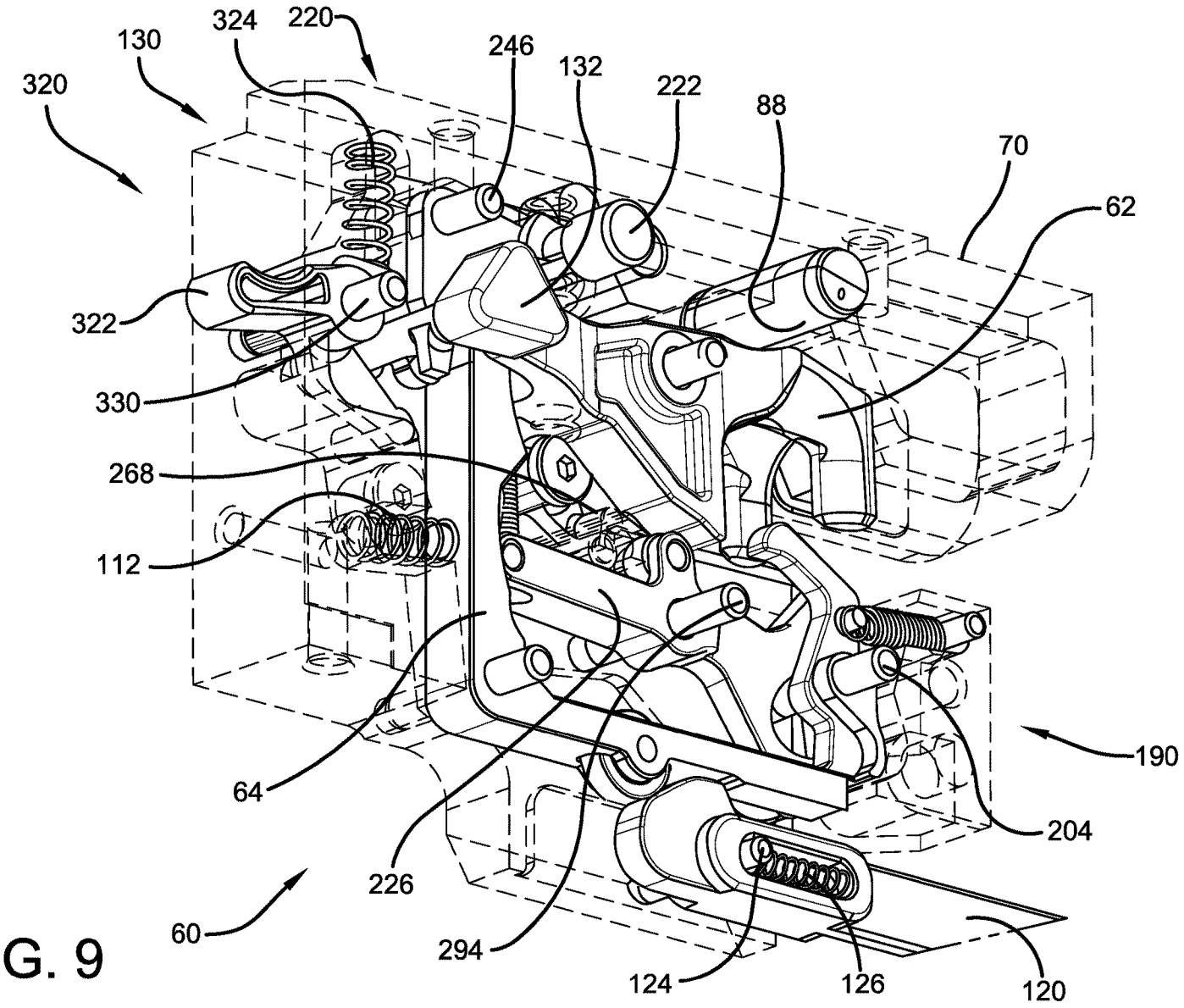
FIG. 9 is a right side perspective view of the components shown FIG. 7.
Figure 10:
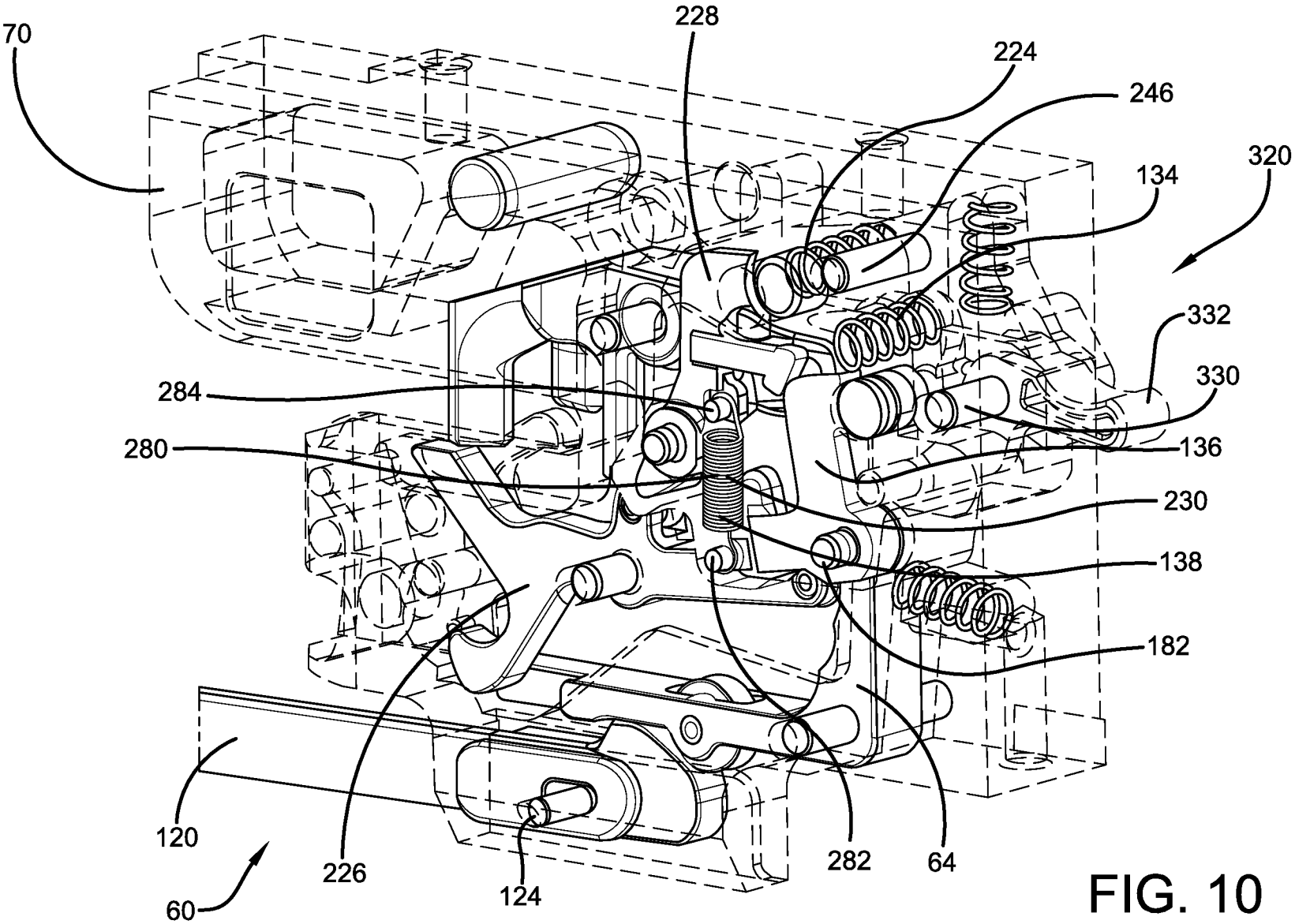
FIG. 10 is a left side perspective view inside the housing of FIG. 7.

With reference now to FIGS. 4, 7-11 and 26-27, when the crossbow 10 is cocked and an arrow (not shown) is being properly inserted into the crossbow, the arrow contacts surface 196 of the dry-fire link 192 causing the dry-fire link 192 to pivot in direction 212 (see FIG. 8). In some embodiments, this pivoting motion of the dry-fire link 192 is limited because surface 194 of the dry-fire link 192 operatively engages surface 214 of the housing 70. When the arrow is removed, the biasing force from the dry-fire link biasing device 210 pivots the dry-fire link 192 in direction 216 back into the dry-fire link first position. Surface 200 of the dry-fire link 192 (see FIG. 27) may be a laterally extending tab having a circular cross-section, as shown, which may be used as will be discussed below.

With reference now to FIGS. 1-2, 7-13, 18, 21, 24-25 and 28-32, the crossbow 10 may include a de-cock mechanism 220 that enables the bowstring 18 to be adjusted from the cocked position to the un-cocked position without shooting the arrow. The de-cock mechanism 220 in some embodiments may include a de-cock activator 222, a de-cock activator biasing device 224, a de-cock link 226, a de-cock lock 228 and a de-cock lock biasing device 230. These components will be discussed in turn.

With reference now to FIGS. 7, 9-11, 18, 21 and 28-30, the de-cock activator 222 may be positioned within the housing 70 and may be selectively movable by the user from a first de-cock activator position (shown in FIGS. 9-10 and 18) that prevents the string latch 62 from being moved into the third string latch position (preventing de-cocking of the bowstring 18) into a second de-cock activator position (shown in FIG. 21) that permits the string latch 62 to be moved into the third string latch position (permitting de-cocking of the crossbow). The de-cock activator 222 may include surface 240 for use by a user to manually move the de-cock activator from the first de-cock activator position into the second de-cock activator position. In some embodiments, when the de-cock activator 222 is in the first de-cock activator position, surface 240 extends outward through a housing opening outside of the housing 70 as shown in FIG. 18. To move the de-cock activator 222 into the second de-cock activator position, the user may push surface 240 inward with the result shown in FIG. 21. In some embodiments, the de-cock activator 222 has surface 242 that extends laterally and that has an opening 244 (see FIG. 30) that receives a pin 246 supported to the housing 70. In this case, as the de-cock activator 222 is moved between the first and second de-cock activator positions, the de-cock activator 222 slides along the pin 246 linearly.

Figure 21:
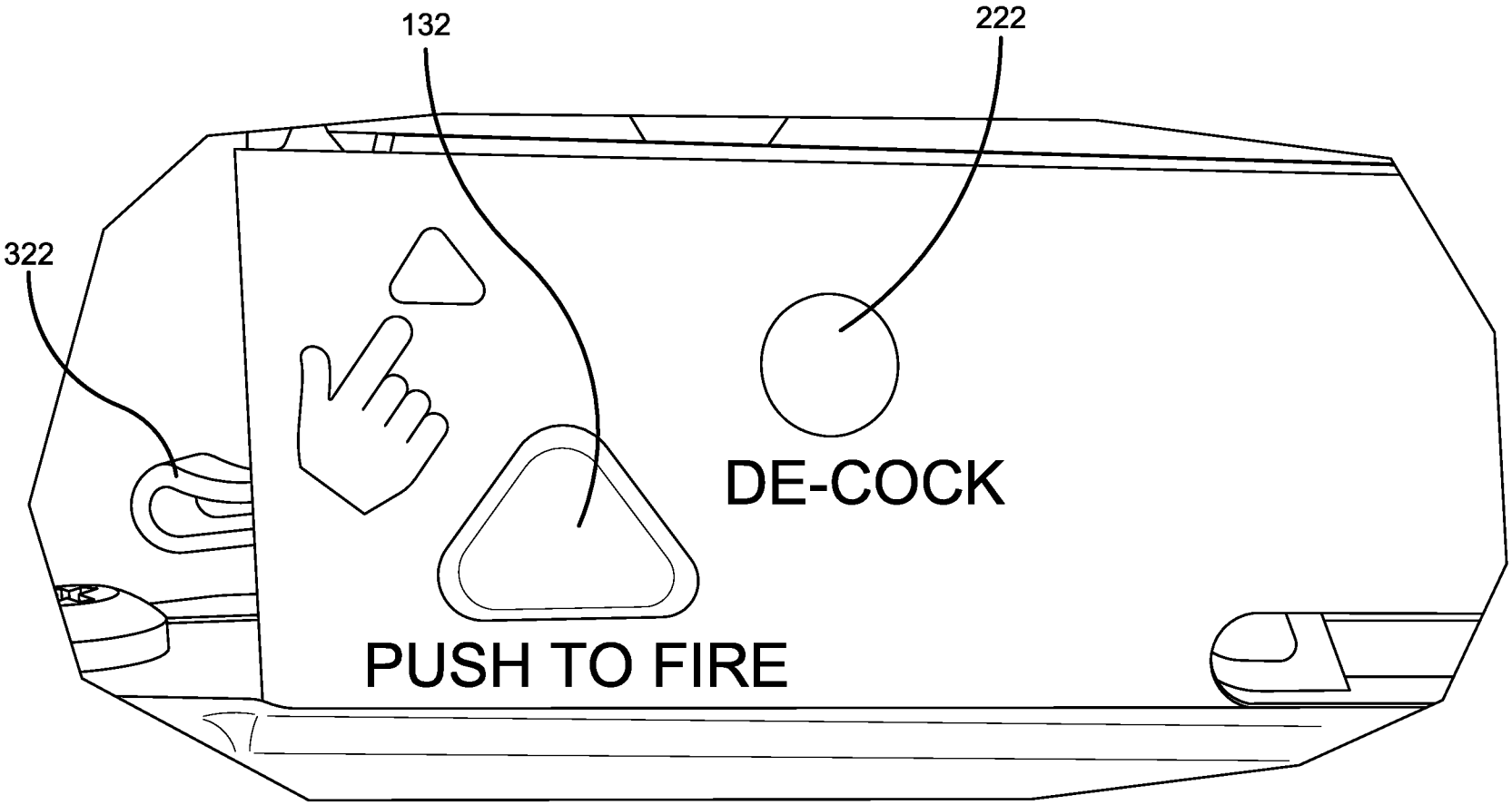
FIG. 21 is a right side view similar to FIG. 18 but showing the safety actuator in a second safety actuator position and the de-cock actuator in a second de-cock actuator position.
Figure 22:
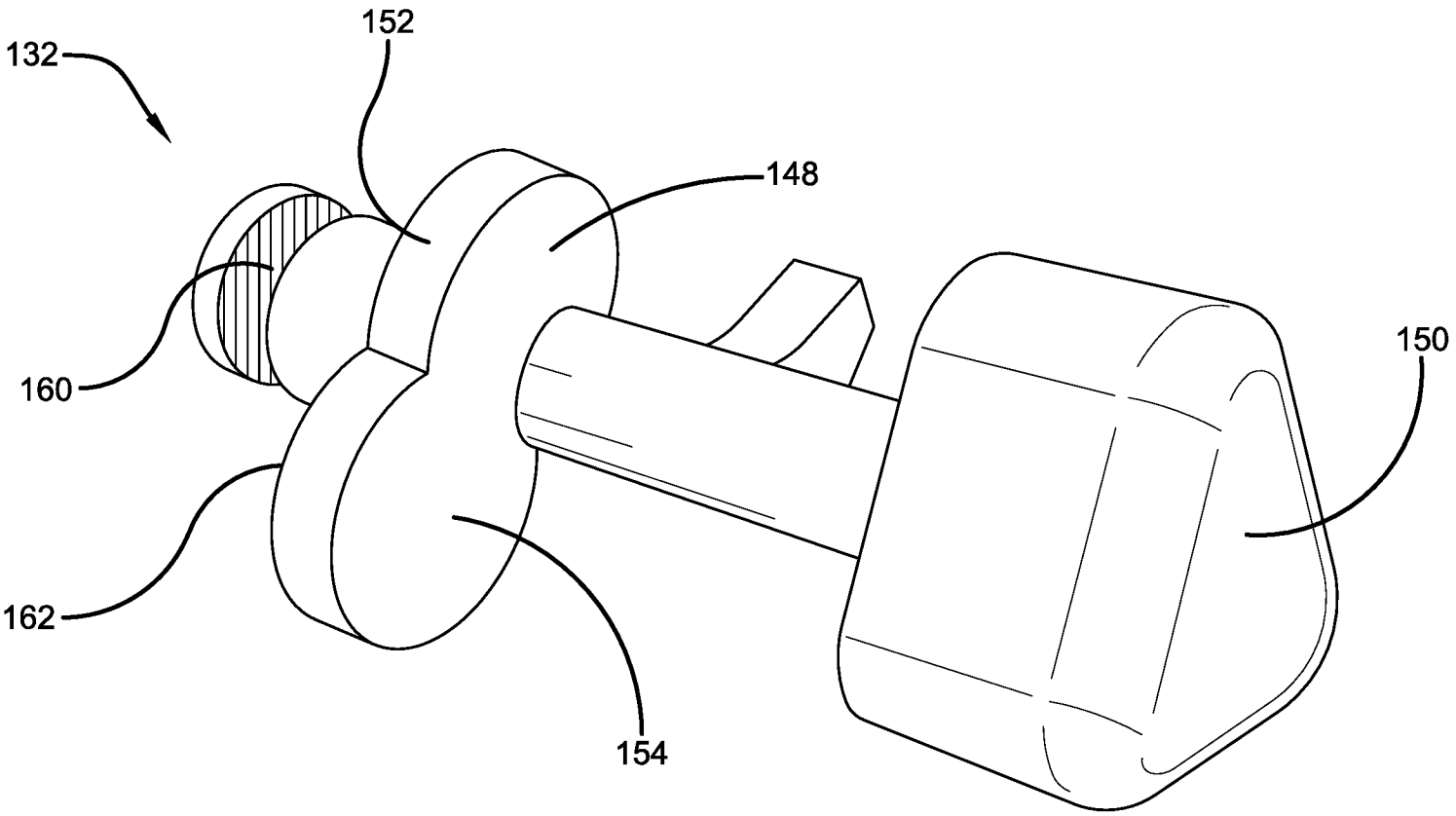
FIG. 22 is a perspective view of a safety actuator.
Figure 23:
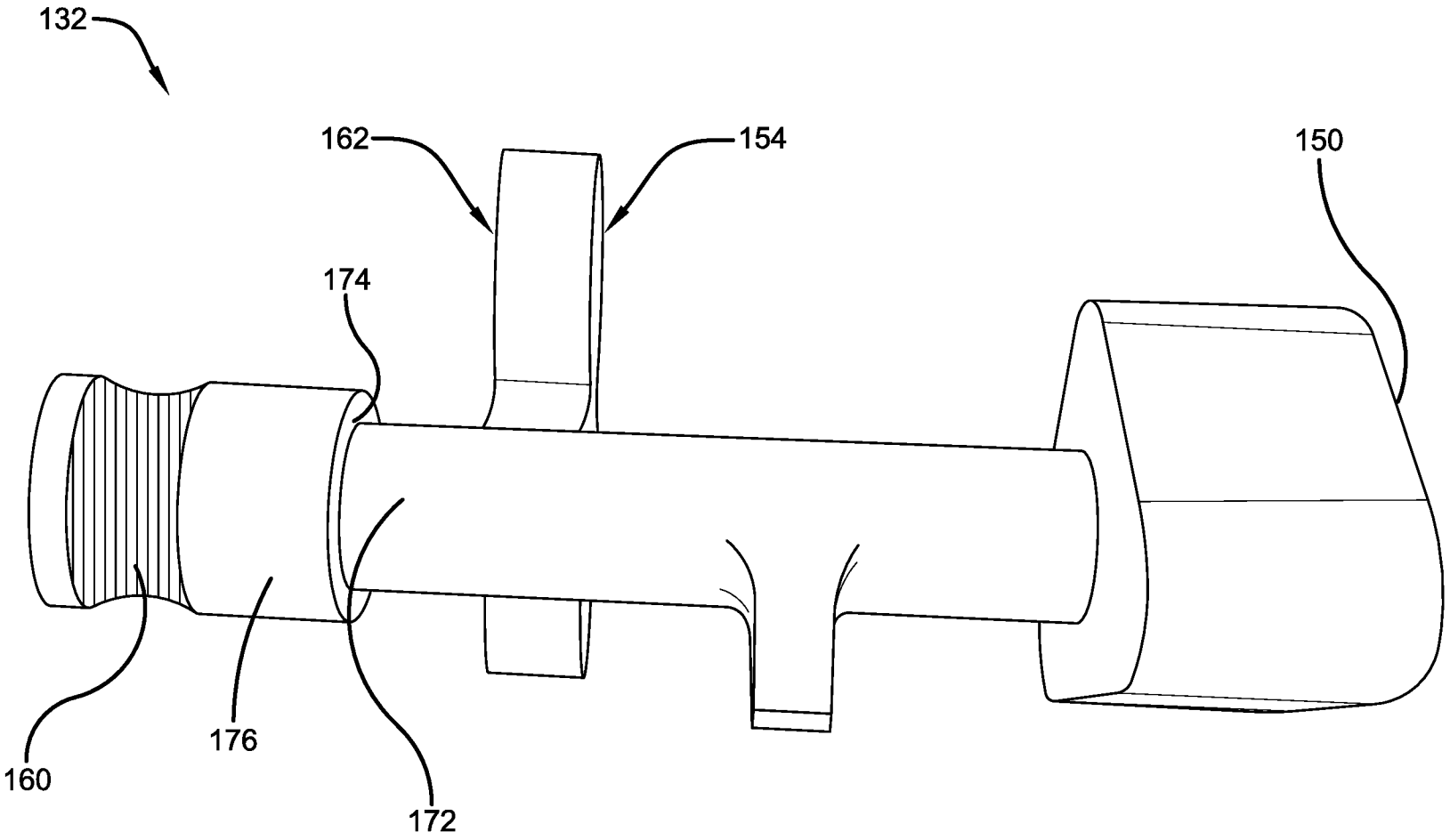
FIG. 23 is a side view of the safety actuator shown in FIG. 22.

With reference now to FIGS. 7, 9-11, 18, 21-22 and 28-30, the de-cock activator 222 may have surface 250 (see FIG. 29) which may be used to prevent the string latch 62 from being moved into the third string latch position. In some embodiments, any attempt to move the string latch 62 into the third string latch position is unsuccessful because such attempted motion would cause surface 254 of the string latch 62 (see FIG. 15) to operatively engage surface 250 of the de-cock activator 232. The proximity of these two surfaces is visible in FIG. 7. Thus, when the de-cock activator 232 is in the first de-cock activator position, it is not possible to de-cock the crossbow. In some embodiments, surface 240 may be positioned on one end of the de-cock activator 222 and surface 250 may be positioned on the opposite end 270 of the de-cock activator 222, as shown. In some embodiments, the end 270 of the de-cock activator 222 that includes contact surface 250 may extend into a housing opening 256 (see FIGS. 20 and 25). Surface 252 of the de-cock activator 222 may be used to operatively engage surface 154 of the safety activator 132 (see FIG. 22). In some embodiments, shown, surfaces 256 and 154 are planar. As a result of this engagement, when the safety activator 132 is in the first safety activator position and the de-cock activator 222 is in the first de-cock activator position, when the user selectively moves the de-cock activator 222 into the second de-cock activator position, the safety activator 132 is moved into the second safety activator position simultaneously. The result is shown in FIG. 21. This provides the advantage that the user never has to individually move the safety activator 132 when it is desired to de-cock the crossbow. Thus, the user can think of the safety activator 132 as being used exclusively for firing or not firing the crossbow 10. In some embodiments, a de-cock activator biasing device 224, such as a spring best seen in FIG. 10, may be used to apply a biasing force to bias the de-cock activator 222 into the first de-cock activator position. For the embodiment shown, the biasing device 224 has one end that operatively engages a surface of the housing 70 and the opposite end operatively engages surface 258 of the de-cock activator 222 (see FIGS. 28-29).

With reference now to FIGS. 7-10, 24-25 and 28-29 a de-cock lock 228 may be positioned within the housing 70 and may be movable between a first de-cock lock position (see FIGS. 10 and 24) that retains the de-cock activator 222 in the second de-cock activator position and a second de-cock lock position (see FIG. 25) that permits the de-cock activator 222 to move into the first de-cock activator position. In some embodiments, the de-cock lock 228 may have surface 260 (see FIG. 24) that operatively engages surface 264 of the de-cock activator 222 (see FIG. 29). The engagement of these surfaces is visible in FIG. 10. In some embodiments, juxtaposed to surface 264 the de-cock activator 222 may have surface 266 that extends outward from surface 264. When the de-cock activator 222 is in the second de-cock activator position and the de-cock lock 228 is in the first de-cock lock position, a side surface of the de-cock lock 228 near surface 260 is juxtaposed to surface 266 to retain the de-cock activator 222 in the second de-cock activator position. When the de-cock lock 228 is in the second de-cock lock position, surface 260 may operatively engage the end 270 of the de-cock activator 222. As seen best in FIGS. 28-29, the end 270 of the de-cock activator 222 may have a circular cross-section. Surface 260 may have a C-shape to match the circumference of the end 270.

With reference now to FIGS. 7-10 and 24-25, in some embodiments the de-cock lock 228 is moved between the first de-cock lock position and the second de-cock lock position by pivoting the de-cock lock 228. The de-cock lock 228 may, for example, have an opening that receives a pivot pin 262, supported to the housing 70, about which the de-cock lock 228 pivots. A de-cock lock biasing device 230, such as a spring, may be used to apply a biasing force to bias the de-cock lock 228 into the into the first de-cock lock position. In some embodiments, not shown, de-cock lock biasing device 138 may be distinct from de-cock lock biasing device 230. For the embodiment show, a single biasing device (hereinafter referred to as an interlock biasing device 280, see FIGS. 8, 10 and 24-25) applies an interlock biasing force that biases the safety lock 136 into the first safety lock position and the de-cock lock 228 into the first de-cock lock position. In one specific embodiment, safety lock 136 has a biasing device reception surface 282 (see FIG. 10) that operatively receives one end of interlock biasing device 280 and de-cock lock 228 has a biasing device reception surface 284 that operatively receives the opposite end of interlock biasing device 280. In some embodiments, shown, surfaces 282 and 284 are laterally extending tabs. The way in which the de-cock lock 228 is selectively moved from the first de-cock lock position into the second de-cock lock position will be described below.

With reference now to FIGS. 7-12 and 31, the de-cock link 226 may be movable between a first de-cock link position (shown in FIGS. 12-13) that retains the trigger link 64 in the second trigger link position and a second de-cock link position (shown in FIGS. 7-11) that does not retain the trigger link 64 in the second trigger link position. In some embodiments, the de-cock link 226 is moved from the second de-cock link position to the first de-cock link position by pivoting the de-cock link 226 in direction 296. The de-cock link 226 may, for example, have an opening 292 (see FIG. 31) that receives a pivot pin 294, supported to the housing 70, about which the de-cock link 226 pivots.

With reference now to FIGS. 7-12, 14, 16-17 and 31-32, the de-cock link 226 may be moved from the second de-cock link position to the first de-cock link position by pivoting the de-cock link 226 in direction 296. In some embodiments, this motion of the de-cock link 226 is achieved by pivoting string latch 62 from the first string latch position into the third string latch position. When this occurs, surface 74 of the string latch 62 (see FIG. 14) may operatively engage surface 300 of the de-cock link 226 (see FIGS. 31 and 12) causing the de-cock link 226 to pivot in direction 296. In some embodiments, shown, surface 74 is slightly concave curved and surface 300 is convex curved. As this motion occurs, surface 302 of the de-cock link 226 may operatively engage surface 96 of the trigger link 64 and then surface 94 of the trigger link 64; causing the trigger link 64 to move from the first trigger link position to the second trigger link position. In some embodiments, shown, surface 94 is sized and shaped such that when surface 302 is received within surface 94, it is able to retain the de-cock link 226 in the second de-cock link position and thus retain the trigger link 64 in the second trigger link position. In some embodiments, shown, surface 94 is sized and shaped such that when surface 302 is received within surface 94, an audible "click" sound is made. This sound provides audible confirmation to the user that the de-cock mechanism 220 is ready to be used to de-cock the crossbow by moving the bowstring 18 from the cocked position to the un-cocked position. In one specific embodiment, shown, surface 302 is convex curved and surface 94 is concave curved. In some embodiments, the motion of the string latch 62 from the first string latch position into the third string latch position is limited by the operative engagement of surfaces 254 and 272 of the string latch 62 (shown in FIG. 15) with the surfaces 274 and 276, respectively, of the de-cock activator 222 (shown in FIG. 29). The proximity of these surfaces is visible in FIG. 7.

Figure 27:
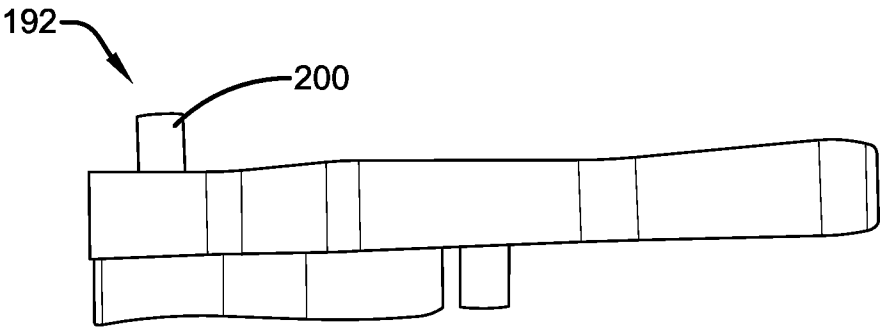
FIG. 27 is an edge view of the dry-fire link shown in FIG. 26.
Figure 28:
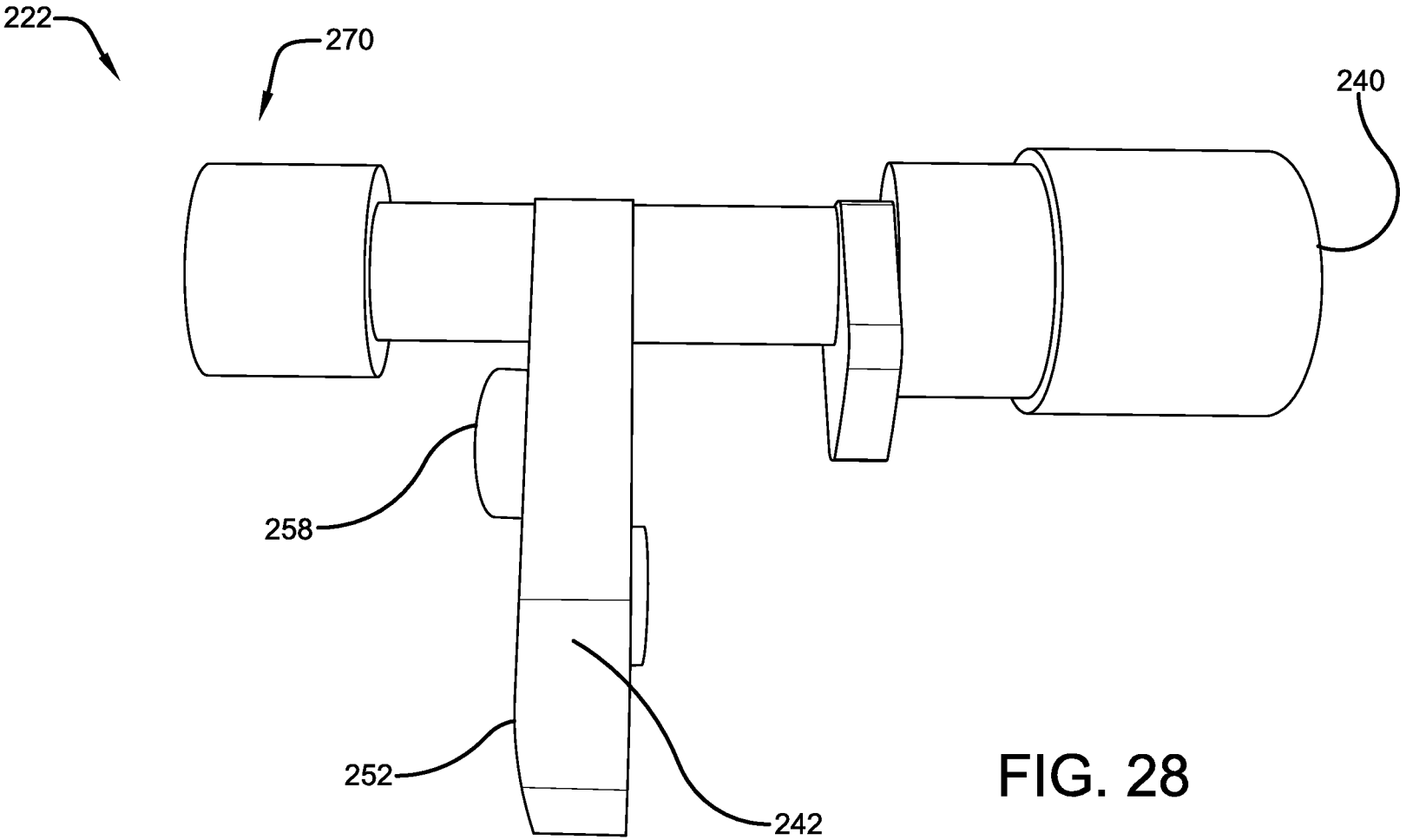
FIG. 28 is a first side view of a de-cock activator.
Figure 29:
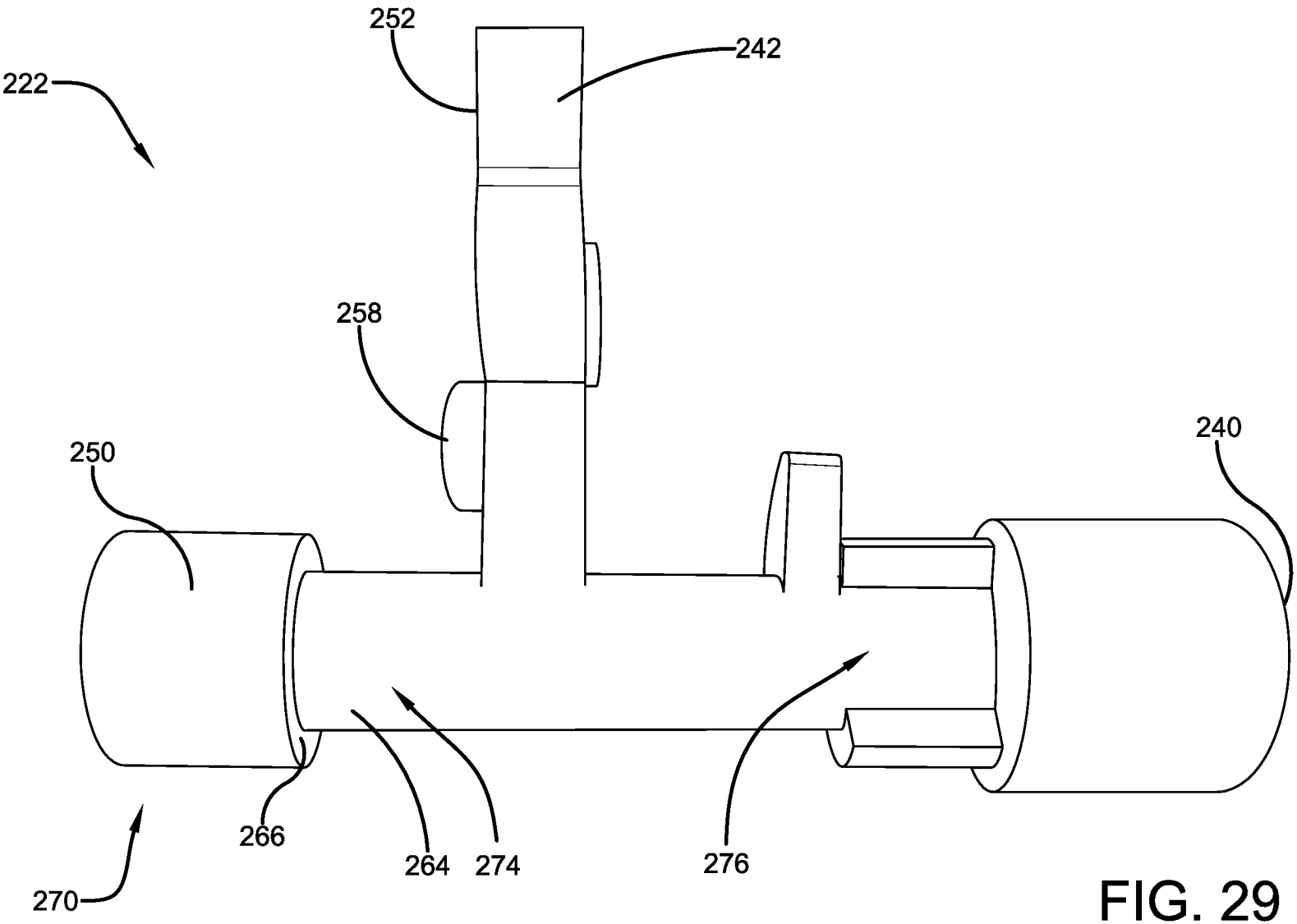
FIG. 29 is an opposite side view of the de-cock activator shown in FIG. 28.
Figure 30:
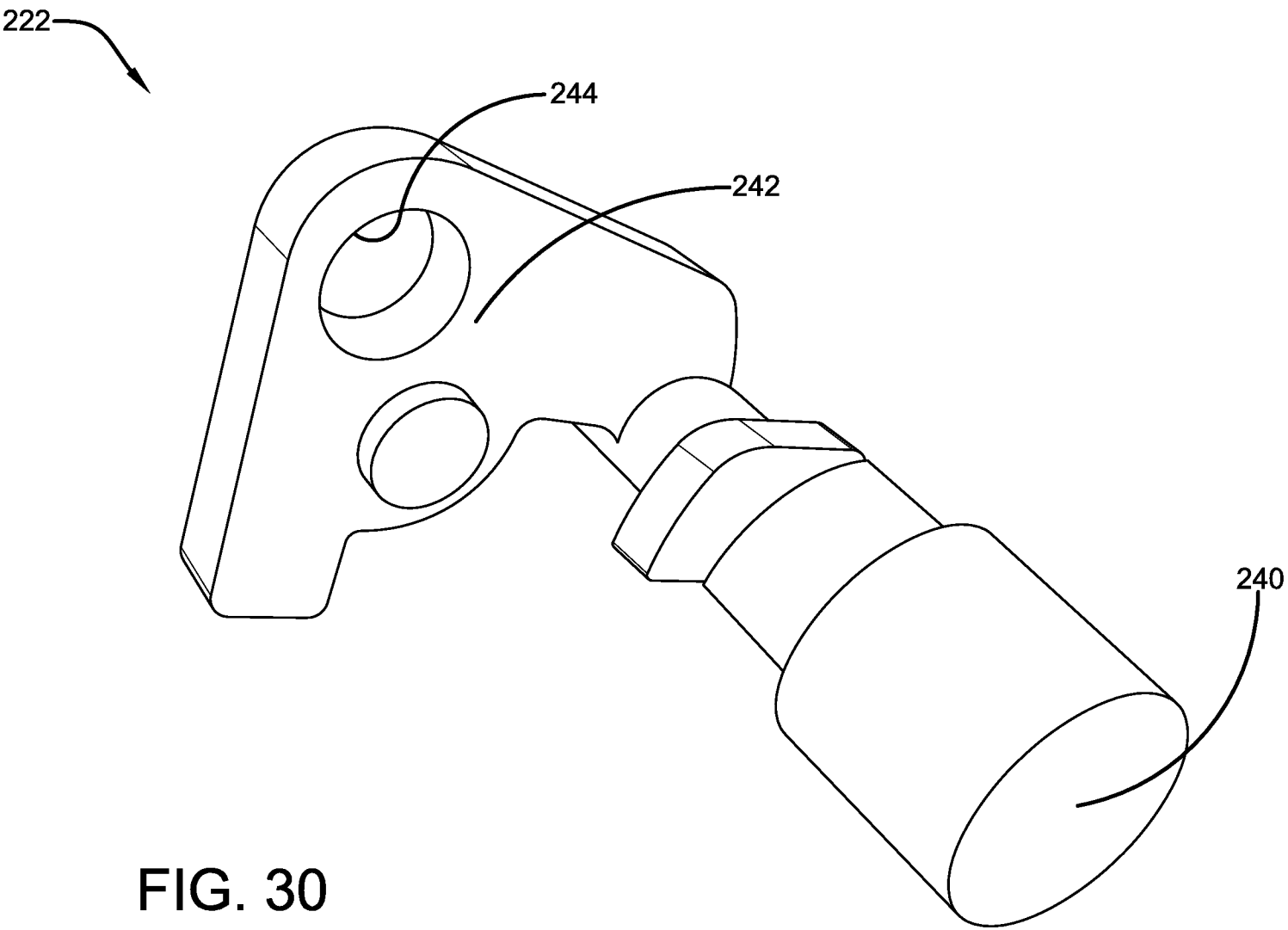
FIG. 30 is a perspective view of the de-cock activator shown in FIG. 28.
Figure 31:
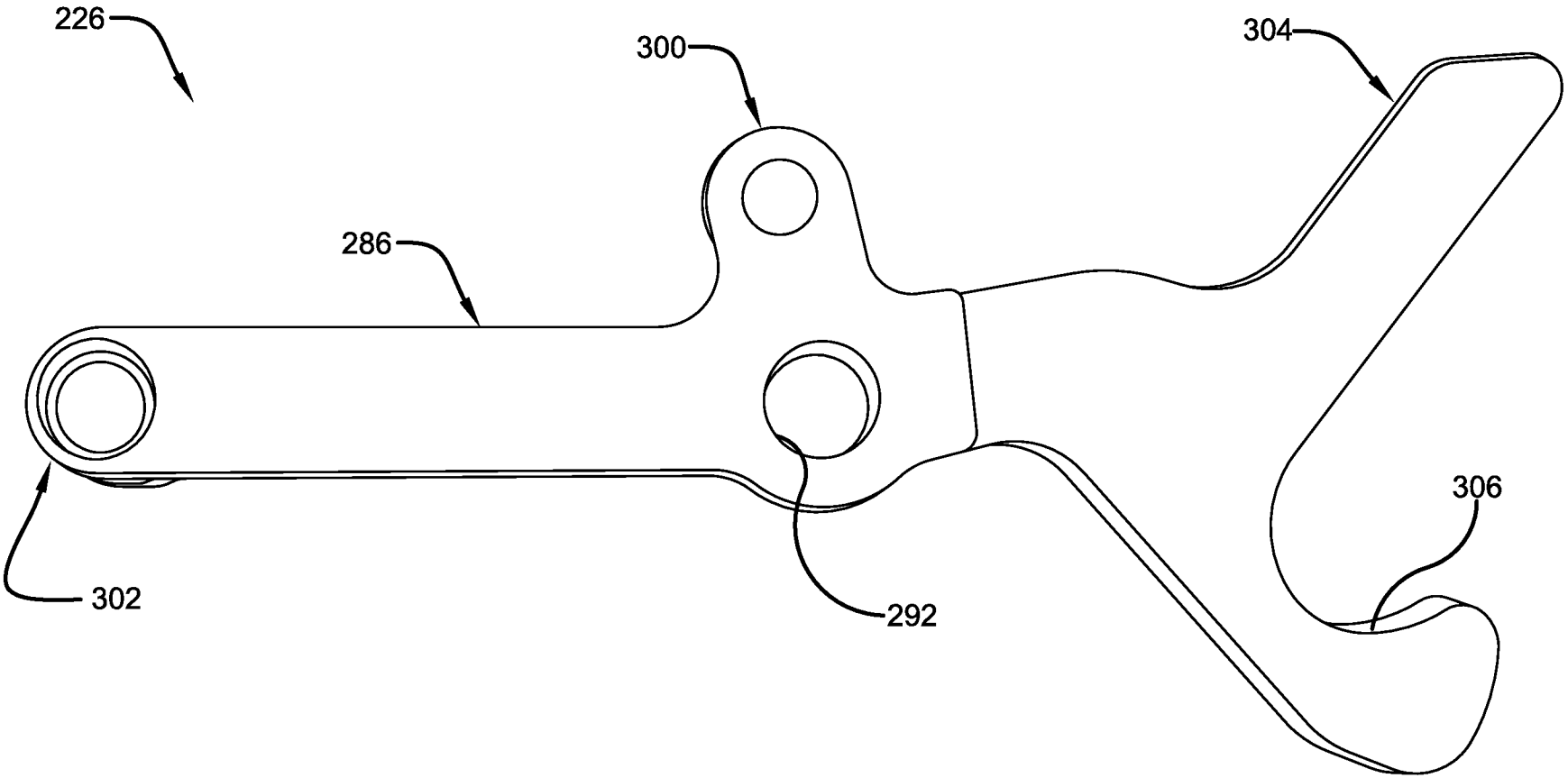
FIG. 31 is a side view of a de-cock link.
Figure 32:
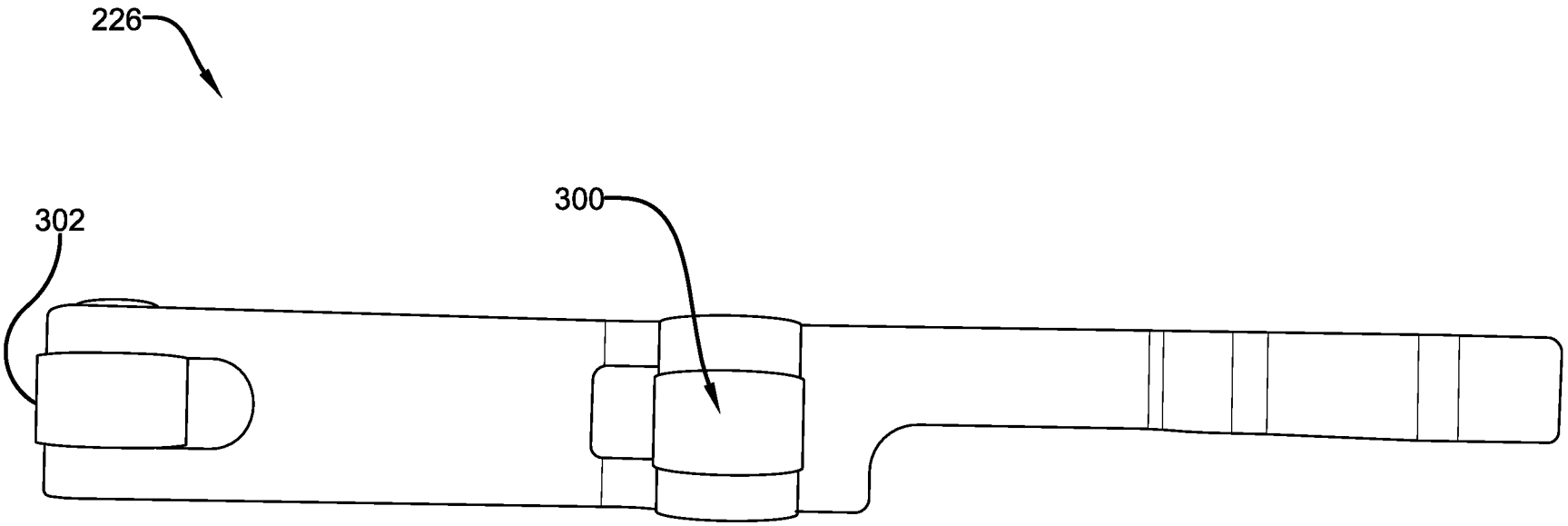
FIG. 32 is an edge view of the de-cock link shown in FIG. 31.
Figure 33:
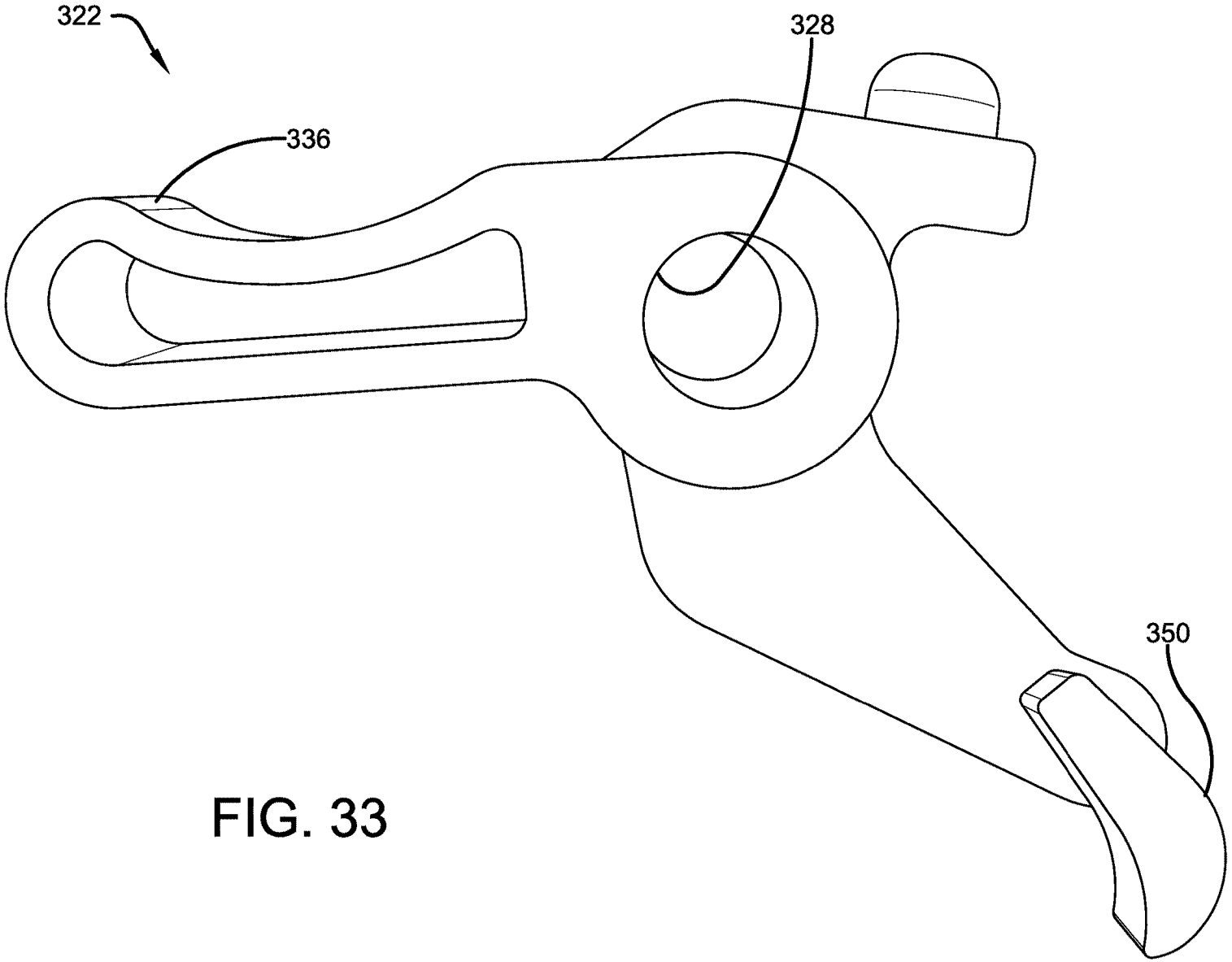
FIG. 33 is a side view of a reset activator.
Figure 34:
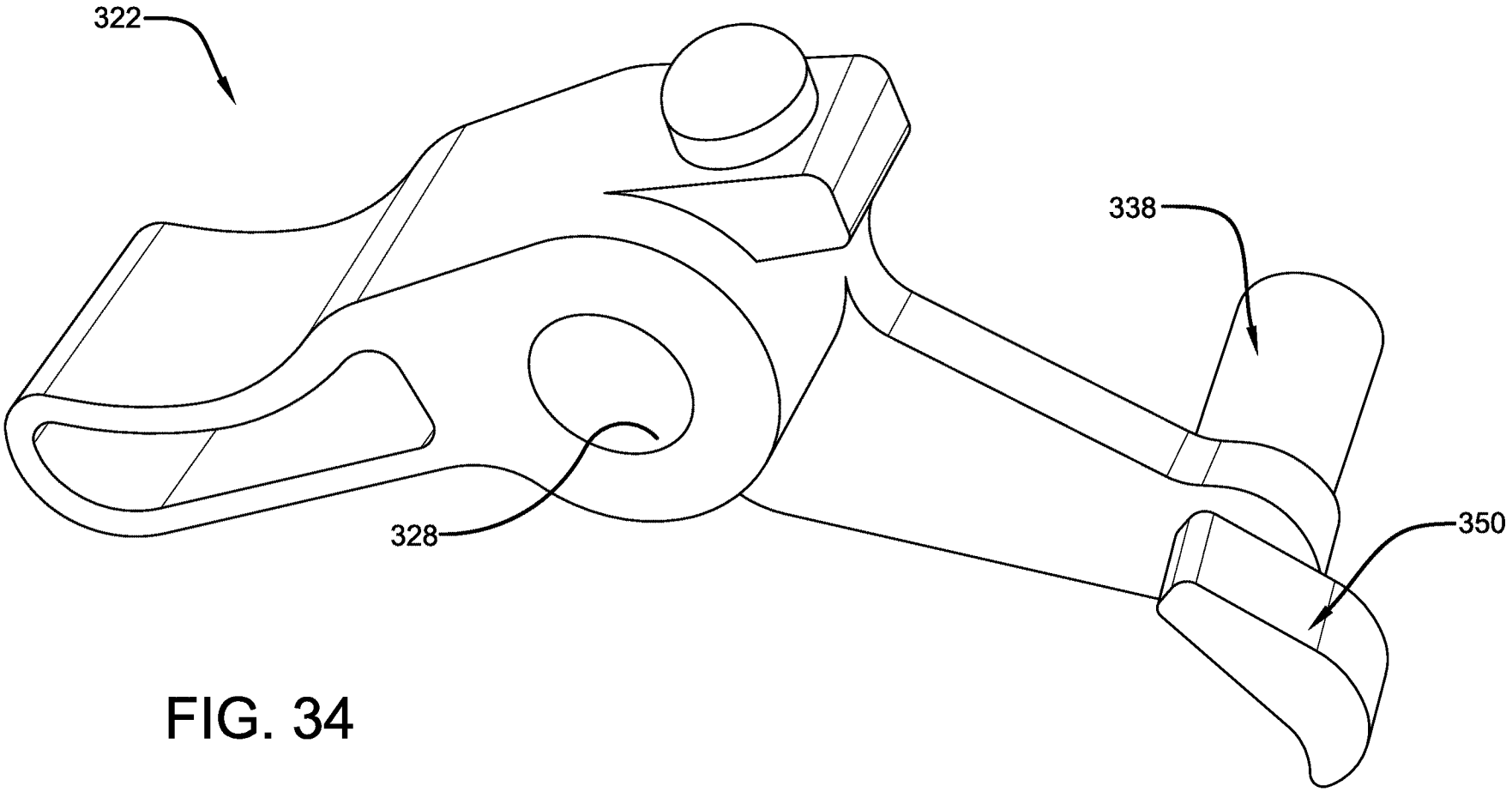
FIG. 34 is a perspective view of the reset activator shown in FIG. 33.

With reference now to FIGS. 7-10, 21, 27 and 31, in some embodiments, surface 306 of the de-cock link 226 (see FIG. 31) may operatively engage surface 200 of the dry-fire link 192 (see FIG. 27). In some embodiments, shown, surface 306 is concave curved and operatively engages tab shaped surface 200. As a result of this engagement, movement of the de-cock link 226 from the second de-cock link position to the first de-cock link position causes the dry-fire link 192 to simultaneously move from the first dry-fire link position to the second dry-fire position. Similarly, movement of the de-cock link 226 from the first de-cock link position to the second de-cock link position causes the dry-fire link 192 to simultaneously move from the second dry-fire link position to the first dry-fire position. The de-cock link 226 may be moved from the first de-cock link position to the second de-cock link position by moving the bowstring 18 distally from the cocked position to the un-cocked position. With this motion, the bowstring 18 may operatively engage surface 304 of the de-cock link 226 (see FIG. 31) causing the de-cock link 226 to pivot in direction 290 back to the second de-cock position and simultaneously causing the dry-fire link 192 to move from the second dry-fire link position to the first dry-fire link position.

Figure 24:
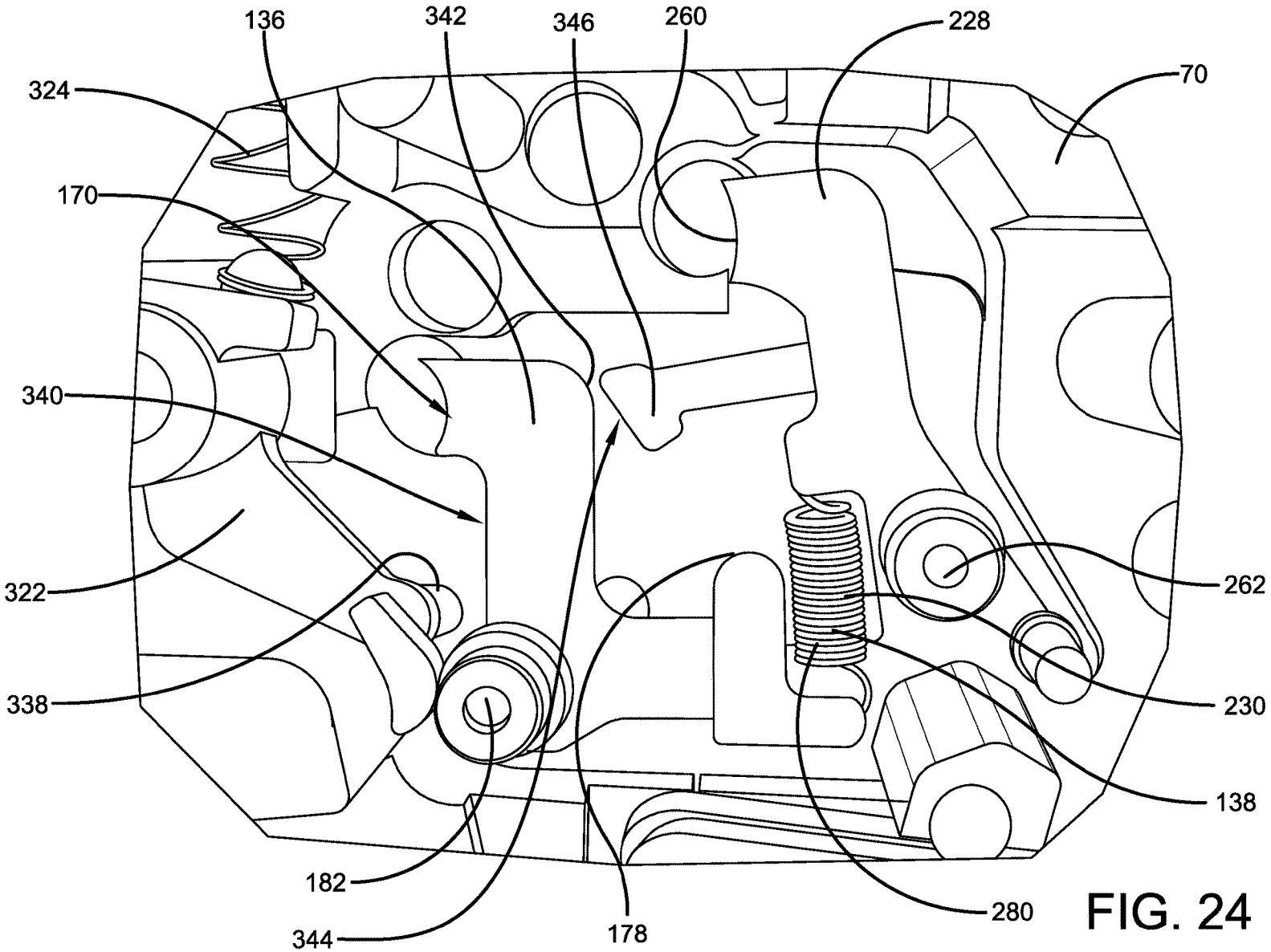
FIG. 24 is a right side view inside a housing showing a reset activator in a first reset activator position, a safety lock in a first safety lock position and a de-cock lock in a first de-cock link position.
Figure 25:
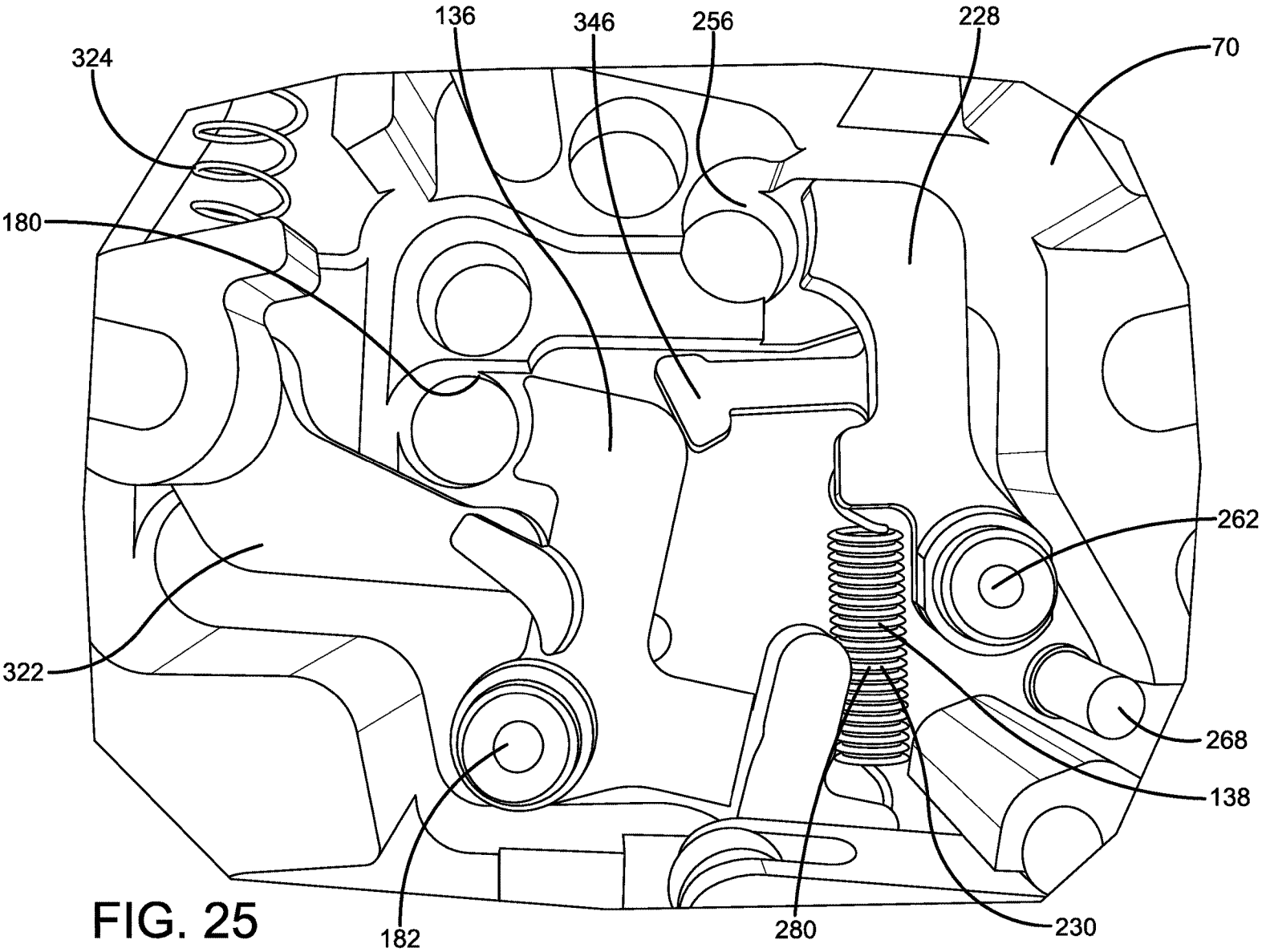
FIG. 25 is a view similar to FIG. 24 but showing the reset activator in a second reset activator position, the safety lock in a second safety lock position and the de-cock lock in a second de-cock link position.

With reference now to FIGS. 1-4, 7, 9-10, 18-21, 24-25 and 33-34, the crossbow 10 may include a reset mechanism 320 that may include a reset activator 322 that may be positioned within the housing 70 and that may be selectively movable from a first reset activator position (shown in FIGS. 7 and 24) into a second reset activator position (shown in FIG. 25). In some embodiments, this movement of the reset activator 322 moves the safety activator 132 from the second safety activator position to the first safety activator position. In some embodiments, this movement of the reset activator 322 moves the de-cock activator 222 from the second de-cock activator position to the first de-cock activator position. In some embodiments, this movement of the reset activator 322 simultaneously moves the safety activator 132 from the second safety activator position to the first safety activator position and the de-cock activator 222 from the second de-cock activator position to the first de-cock activator position. The reset mechanism 320 may include a reset activator biasing device 324 that applies a reset activator biasing force that biases the reset activator 322 into the first reset activator position.

With reference now to FIGS. 7, 9-10 and 33-34, in some embodiments, the reset activator 322 may be moved between the first and second reset activator positions by pivoting the reset activator 322. The reset activator 322 may, for example, have an opening 328 that receives a pivot pin 330, supported to the housing 70, about which the reset activator 322 pivots. In some embodiments, the reset activator 322 is moved from the first reset activator position to the second reset activator position by pivoting the reset activator 322 in direction 332. The biasing device 324 may bias the reset activator 322 to pivot about pivot pin 330 in direction 334.

With reference now to FIGS. 4, 7, 9-10, 24-25, and 33-34, in some embodiments, the reset activator 322 may include a surface 336 for use by a user to manually move the reset activator 322 from the first reset activator position into the second reset activator position. In some embodiments, shown, surface 336 is concave curved and facing upward which is useful in receiving the user's finger. In some embodiments, when the reset activator 322 is in the first reset activator position, surface 336 extends outward through a housing opening outside of the housing 70 as shown in FIG. 4. In some embodiments, shown, the surface 336 extends proximally. To move the reset activator 322 into the second reset activator position, the user may push surface 336 downward with the result shown in FIG. 18. In some embodiments, surface 336 is positioned on one end of the reset activator 322 and the opposite end of the reset activator has a surface 338 (see FIGS. 24 and 34) that selectively operatively engages surface 340 of the safety lock 136 (see FIG. 24). In some embodiments, shown, surface 338 is convex curved and surface 340 is planar. When the reset activator 322 is moved from the first reset activator position into the second reset activator position, surface 338 may slide on surface 340. The engagement of surfaces 338 and 340 is visible in FIG. 25.

With reference now to FIGS. 7, 9-10 and 24-25, in some embodiments, when the user moves the reset activator 322 from the first reset activator position into the second reset activator position, the safety lock 136 may move from the first safety lock position to the second safety lock position by pivoting clockwise (in FIGS. 24-25) about pivot pin 182. In some embodiments, safety lock 136 may have a surface 342 that operatively engages a surface 344 of the de-cock lock 228 (see FIG. 24). In some embodiments, shown, surface 344 is on a proximal end of an extension 346 that extends proximally from the de-cock lock 228. As a result of the engagement of surfaces 342 and 344, movement of safety lock 136 from the first safety lock position to the second safety lock position causes de-cock lock 228 to move from the first de-cock lock position to the second de-cock lock position by pivoting de-cock lock 228 clockwise (in FIGS. 24-25) about pivot pin 262.

With reference now to FIGS. 1-4, 7-11 and 18-20, operation of the crossbow 10 to fire the crossbow will now be described. First the user may use the cocking mechanism 30 to move the bowstring 18 from the un-cocked position to the cocked position. As explained above, in some embodiments cocking the bowstring 18 is accomplished using a drawing mechanism 34 and a claw 32. The user may then counter rotate the handle 50 to remove tension from the cocking cable segments 44, 44 and then remove and store the claw 32. The handle 50 then may be removed, if desired. Before the crossbow 10 can be fired, the user may have to do two things. First, the user may have to properly insert the arrow (not shown). Insertion of the arrow causes the dry-fire link 192 to move from the first dry-fire link position to the second dry-fire link position. Second, the user may have to move the safety activator 132 from the first safety activator position into the second safety activator position. Note that movement of the safety activator 132 from the first safety activator position into the second safety activator position does not move the de-cock activator 222 from the first de-cock activator position into the second de-cock activator position. As explained above, in some embodiments this movement of the safety activator 132 is accomplished by pushing the safety activator 132 laterally inward overcoming the biasing force of the safety activator biasing device 134. If the user now pulls the trigger 66, the crossbow 10 will fire; shooting the arrow and returning the crossbow 10 to the un-cocked position. Firing the crossbow 10 moves the trigger link 64 from the first trigger link position (shown in FIG. 8) to the second trigger link position (shown in FIG. 11). This movement of the trigger link 64 permits the string latch biasing device 84 to move the string latch 62 from the first string latch position (shown in FIG. 8) to the second string latch position (shown in FIG. 11).

Figure 11:
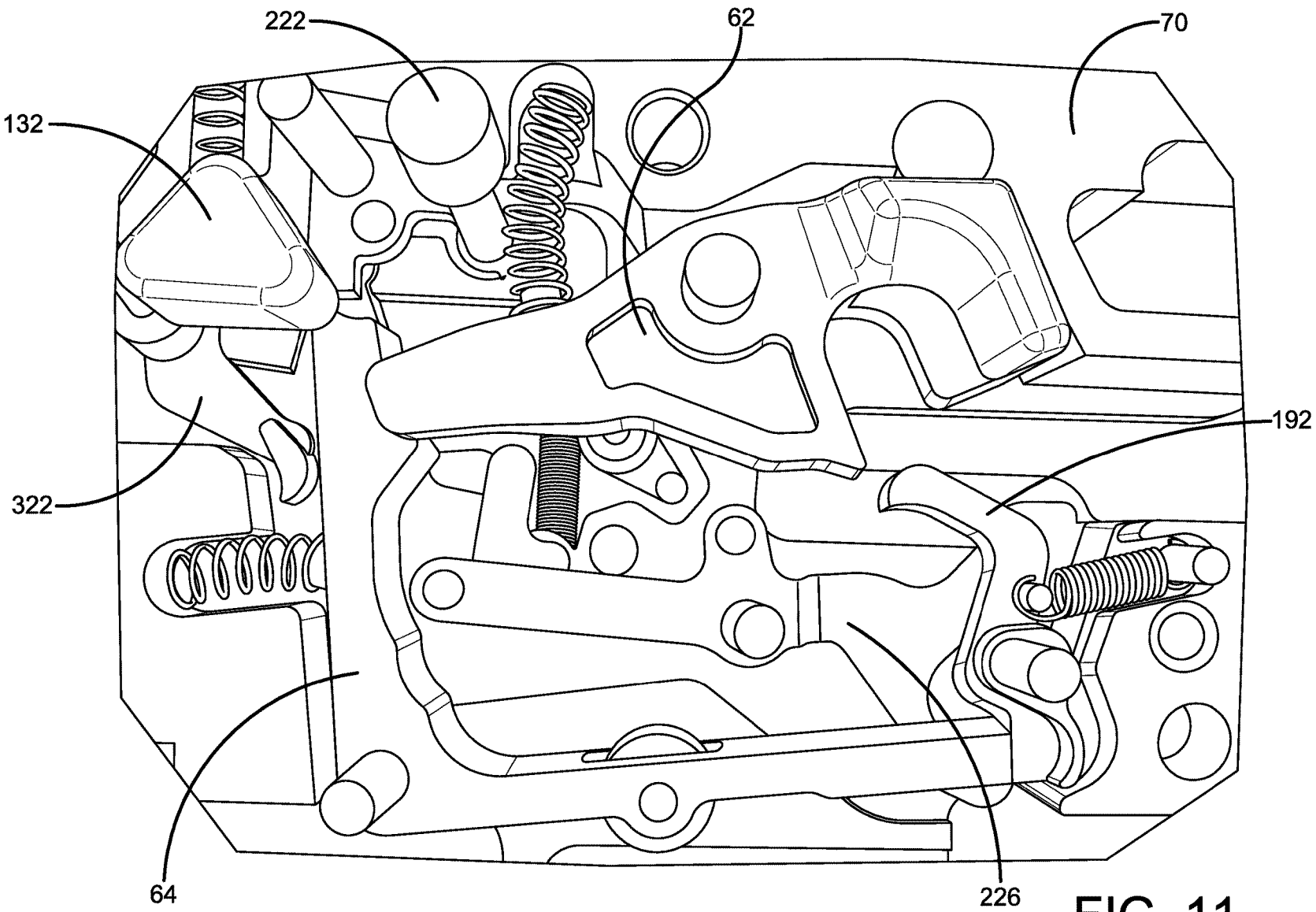
FIG. 11 is a right side view similar to FIG. 8 showing the string latch in the second string latch position and the de-cock link in the second de-cock link position.
Figure 12:
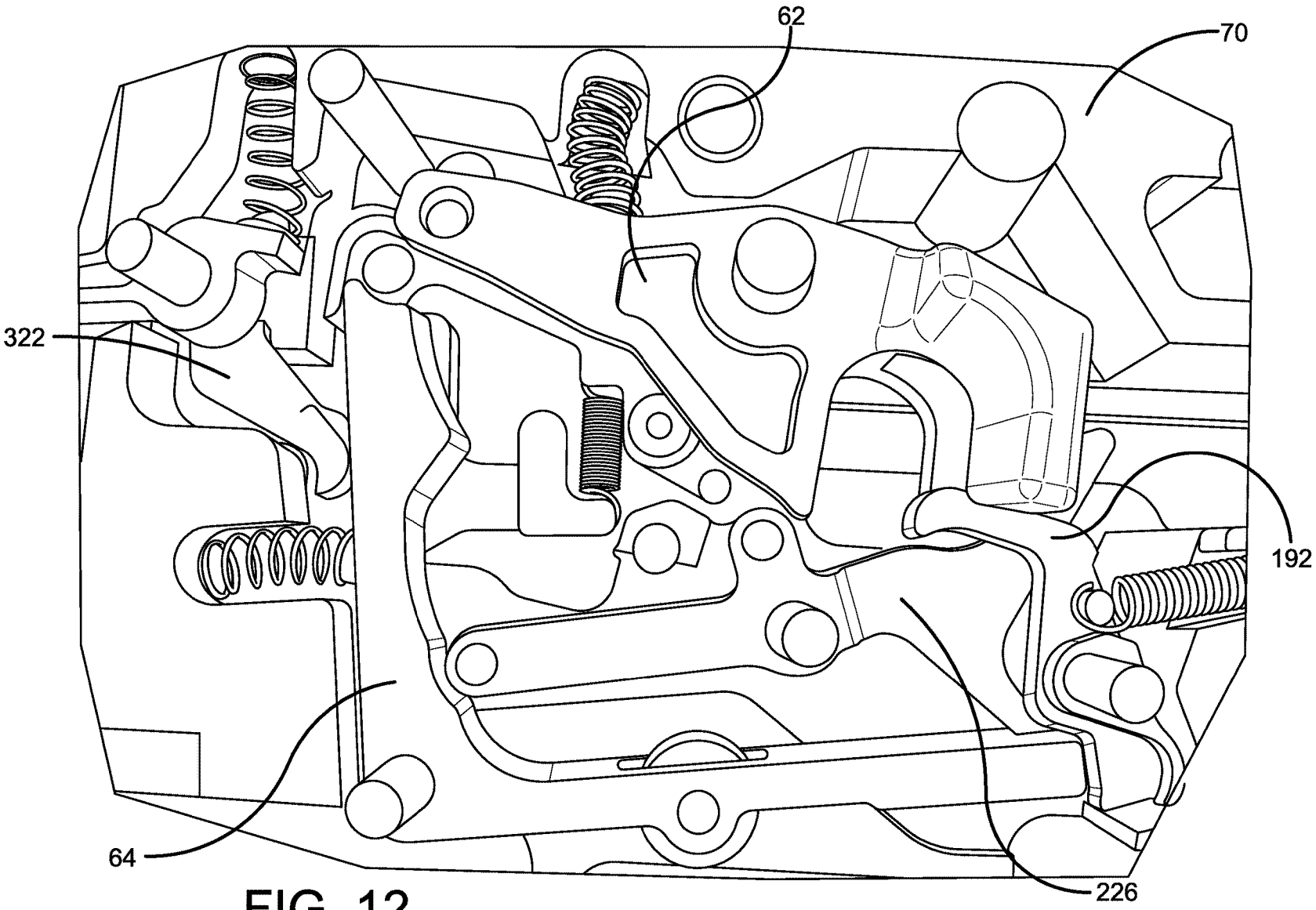
FIG. 12 is a view similar to FIG. 11 but showing the string latch in the third string latch position and the de-cock link in the first de-cock link position.
Figure 13:
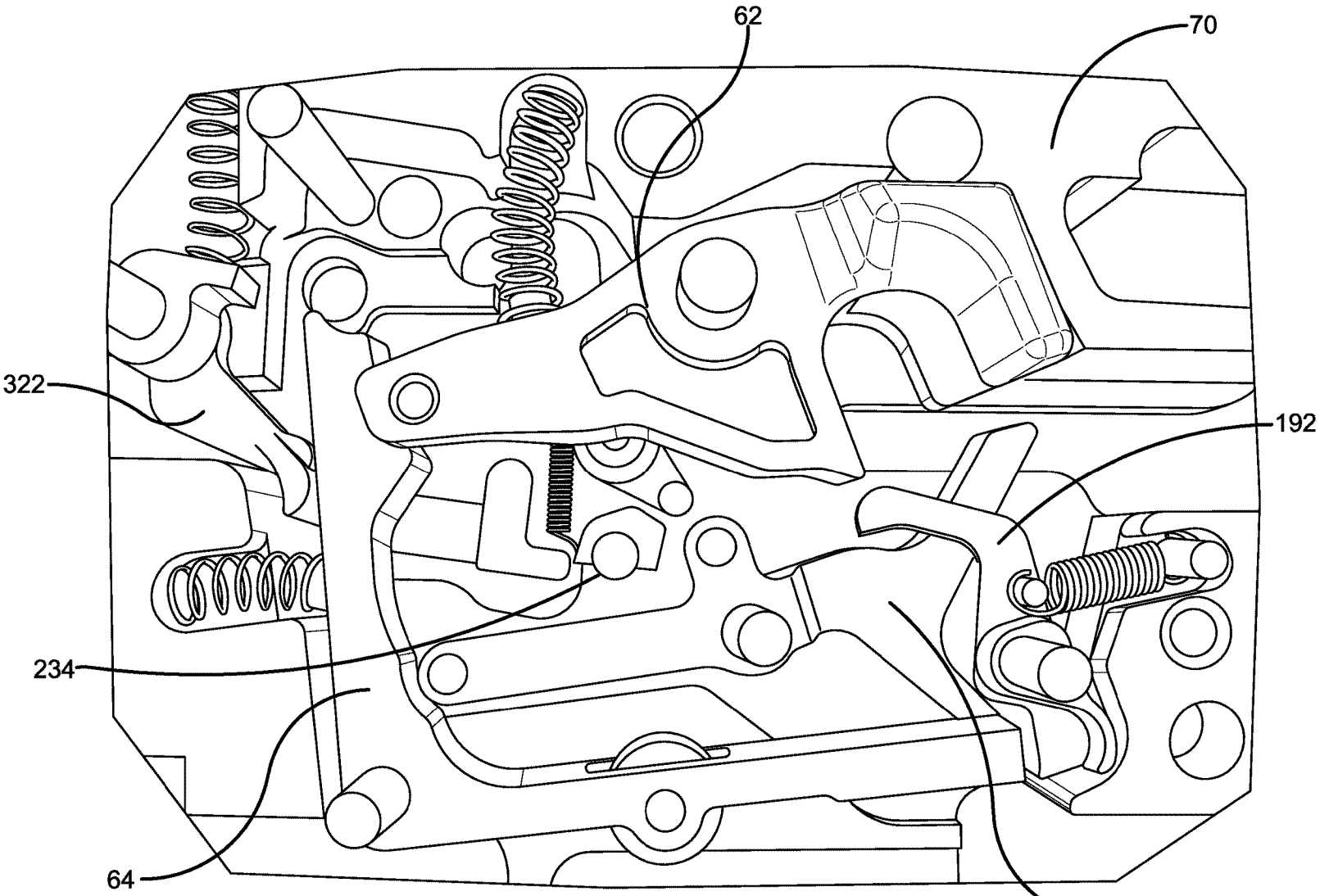
FIG. 13 is a view similar to FIG. 12 but showing the string latch in the second string latch position and the de-cock link in the first de-cock link position.
Figure 14:
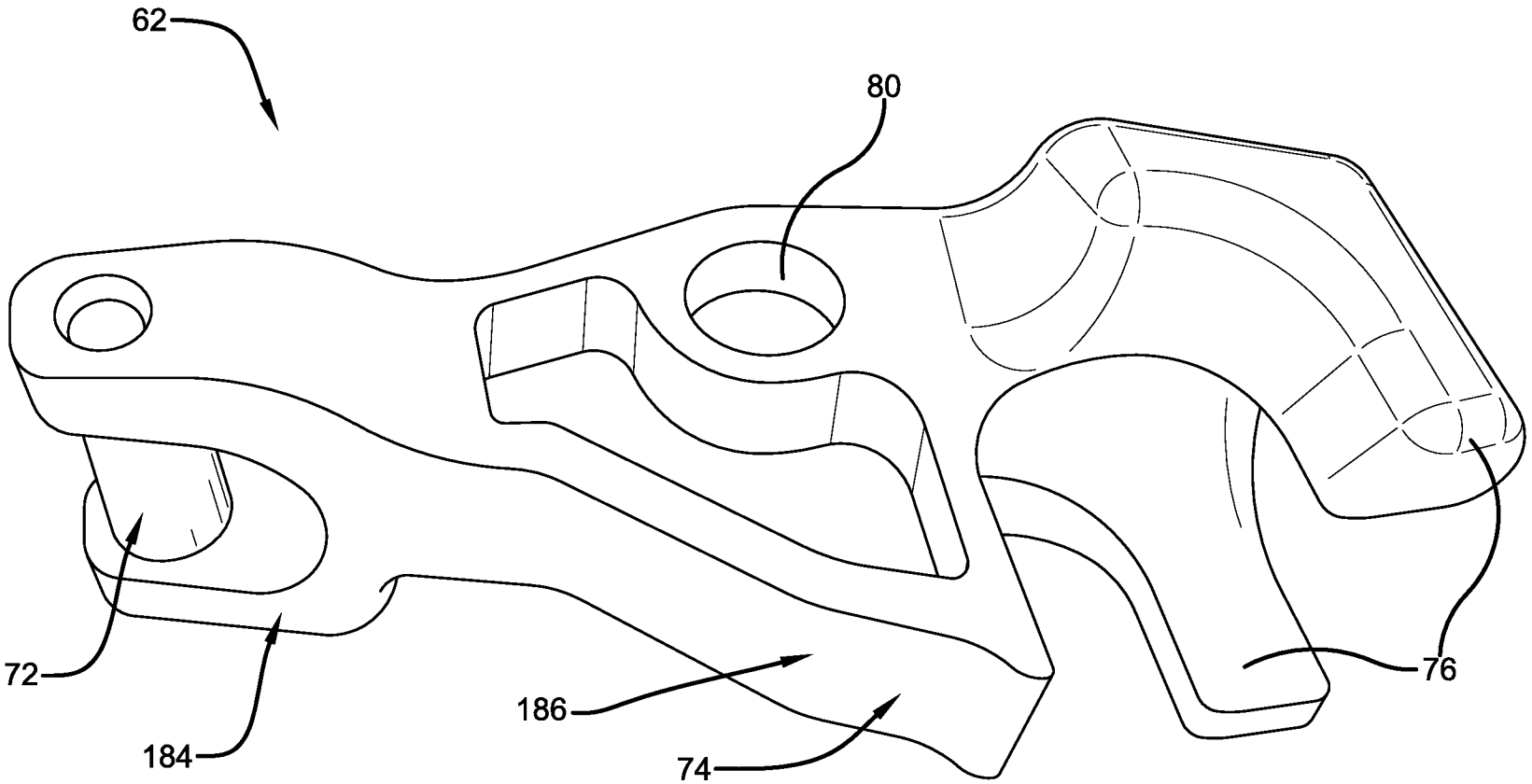
FIG. 14 is a perspective bottom view of a string latch.
Figure 15:
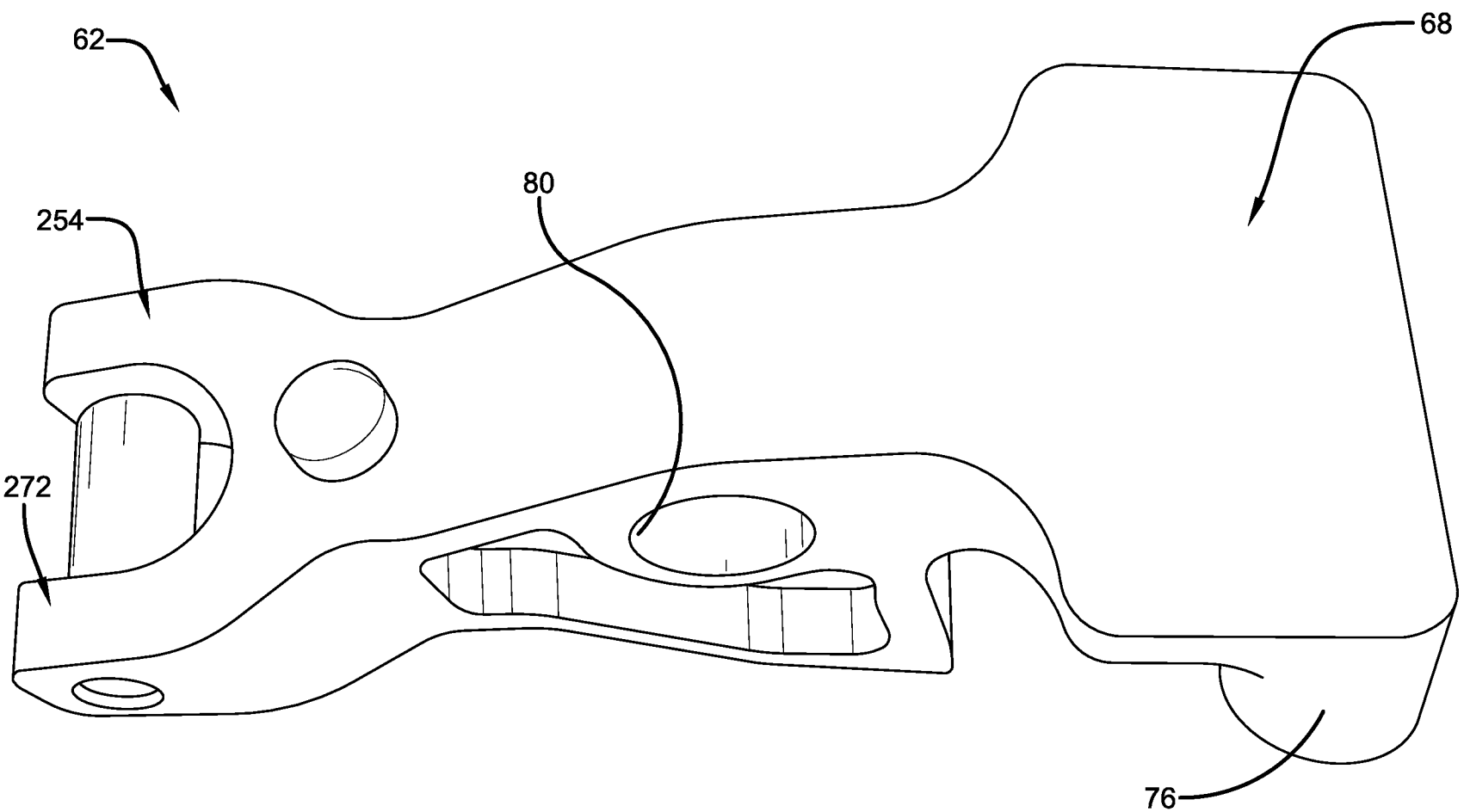
FIG. 15 is a perspective top view of the string latch shown in FIG. 14.
Figure 16:
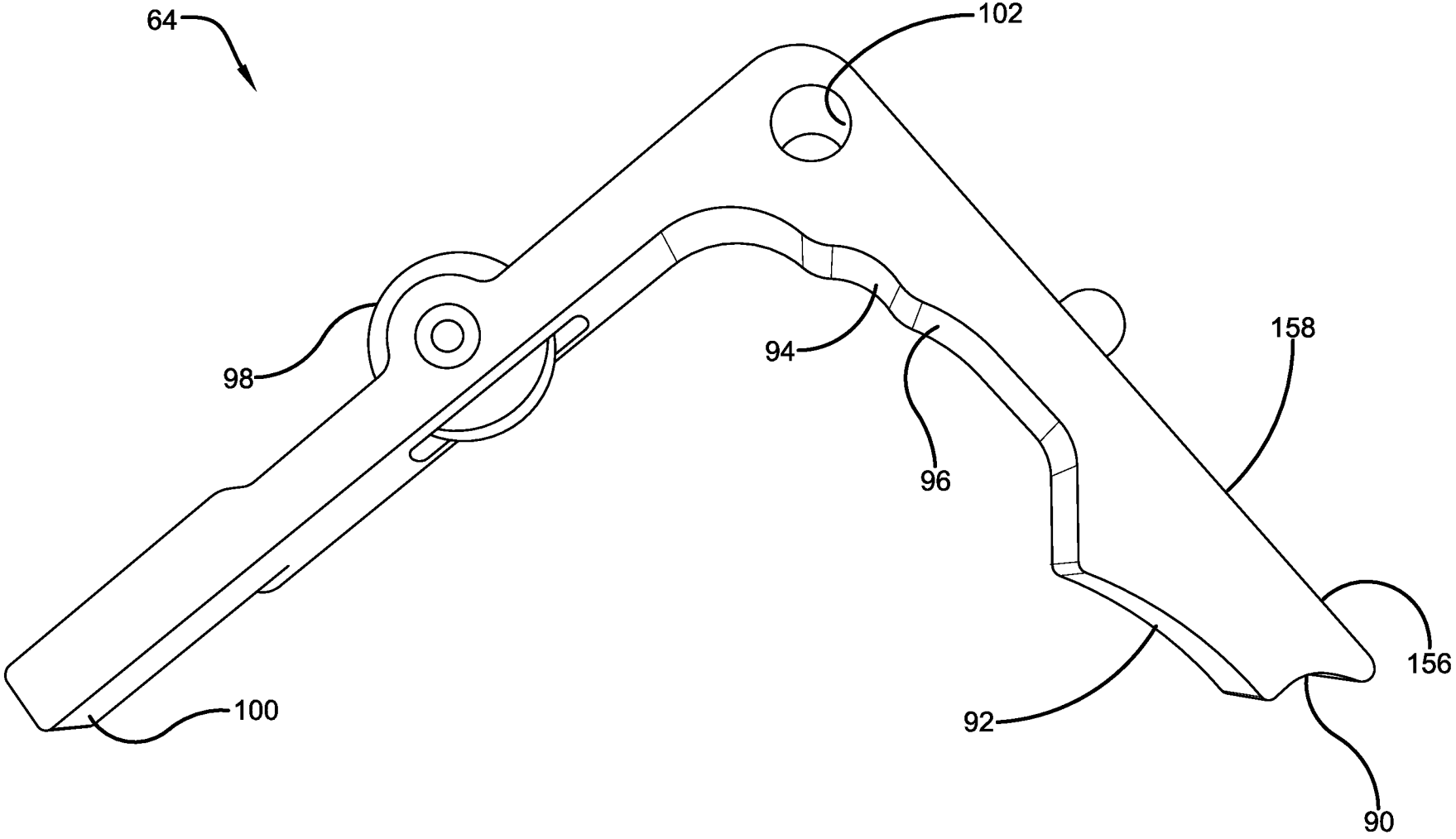
FIG. 16 is a side view of a trigger link.
Figure 17:
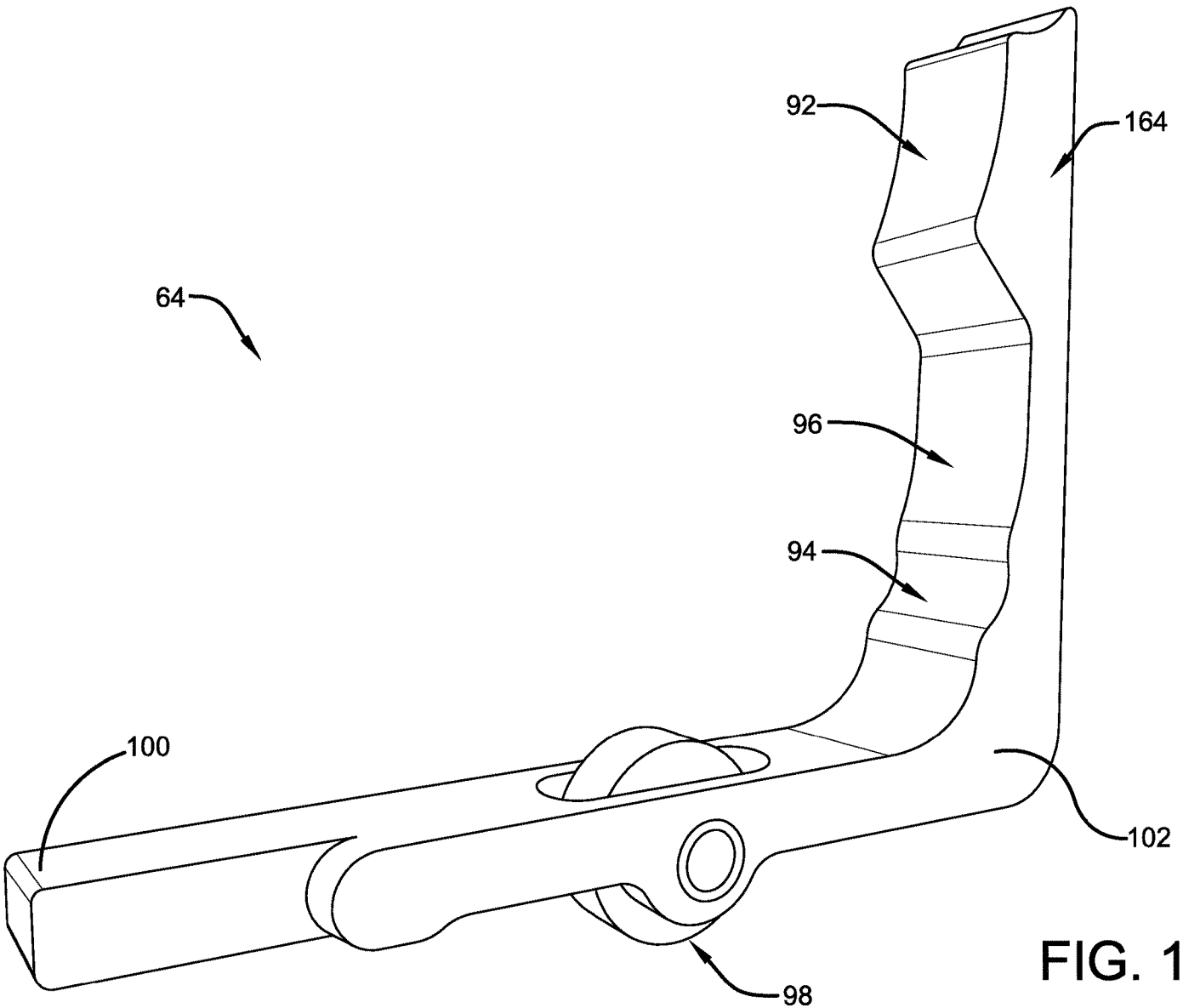
FIG. 17 is a side perspective view of the trigger link shown in FIG. 16.

With reference now to FIGS. 7-11 and 24-25, in some embodiments, the safety lock 136 may have a surface 178 (see FIGS. 24 and 7) that operatively engages surface 184 of the string latch 62 (see FIG. 14) when the string latch 62 moves into the second string latch position. The engagement of surface 184 with surface 178 is shown in FIG. 11. This engagement causes the safety lock 136 and the de-cock lock 228 to pivot clockwise from their safety lock and de-cock lock first positions (shown in FIG. 24) to their safety lock and de-cock lock second positions (shown in FIG. 25). This permits the de-cock activator biasing device 224 to maintain the de-cock activator 222 in the first de-cock activator position. Even if the user moved the de-cock activator 222 into the second de-cock activator position, once the de-cock activator 222 is released by the user, the de-cock activator biasing device 224 will immediately move the de-cock activator 222 back into the first de-cock activator position.

With reference now to FIGS. 7-10 and 18-20, if the user decides not to fire the crossbow after moving the safety activator 132 from the first safety activator position to the second safety activator position, the user can reset the safety activator 132. In one embodiment, the user can reset the safety activator 132 by moving the reset activator 322 from the first reset activator position to the second reset activator position overcoming the biasing force of the reset activator biasing device 324. This motion causes the safety lock 136 to move from the first safety lock position to the second safety lock position, overcoming the biasing force of the safety lock biasing device 138. This permits the safety activator biasing device 134 to move the safety activator 132 from the second safety activator position back to the first safety activator position. When the user releases the reset activator 322, the reset activator biasing device 324 moves the reset activator 322 from the second reset activator position back to the first reset activator position. Note that throughout these actions the de-cock activator 222 remains in the first de-cock activator position.

With reference now to FIGS. 1-4, 7-10, 18 and 21, operation to de-cock the crossbow by moving the bowstring 18 from the cocked position to the un-cocked position will now be described. With the bowstring 18 in the cocked position, the user may remove the arrow if it had been inserted. The user may then place the claw 32 back onto the main beam 12 in engagement with the bowstring 18 and put the handle 50 back on. Next, the user may rotate the handle 50 so that the cocking cable segments 44, 44 are taut (shown in FIG. 4). The user may then move the de-cock activator 222 from the first de-cock activator position into the second de-cock activator position. As explained above, in some embodiments this is accomplished by pushing the de-cock activator 222 laterally inward overcoming the biasing force of the de-cock activator biasing device 224. As also explained above, moving the de-cock activator 222 from the first de-cock activator position into the second de-cock activator position simultaneously moves the safety activator 132 from the first safety activator position into the second safety activator position—permitting movement of the string latch 62 and the trigger link 64.

With reference now to FIGS. 1-3, 7-10, 12-14 and 24-25, next the user may rotate handle 50 drawing the claw 32 and bowstring 18 further proximally. This motion of the claw 32 causes the bowstring 18 to operatively engage surface 106 of the string latch 62 (shown in FIG. 8) moving the string latch 62 from the first string latch position to the third string latch position. As explained above, this motion of the string latch 62 causes the de-cock link 226 to move from the second de-cock link position to the first de-cock link position; which causes the trigger link 64 to move from the first trigger link position to the second trigger link position. In some embodiments, the motion of the string latch 62 from the first string latch position to the third string latch position causes the operative engagement of surface 186 of the string latch 62 (shown in FIG. 14) with surface 268 of the de-cock lock 228 (shown in FIGS. 8-9). This engagement, shown in FIG. 12, may cause the de-cock lock 228 to pivot clockwise (as shown in FIG. 24) about pivot pin 262. In some embodiments, shown, surface 186 is convex curved and surface 268 is a laterally extending tab having a circular cross-section.

With reference now to FIGS. 1-2, 7-10, 12-13 and 24-25, the user can continue to counter rotate handle 50 permitting the claw 32 and bowstring 18 to continue moving distally. This motion permits the string latch biasing device 84 to move the string latch 62 in direction 78 (see FIG. 8). When the string latch 62 comes out of engagement with the de-cock activator 222, the de-cock activator biasing device 224 moves the de-cock activator 222 from the second de-cock activator position into the first de-cock activator position. Continued counter rotation of handle 50 permits further distal movement of the claw 32 and bowstring 18 which moves the bowstring 18 away from surface 106 of the string latch 62 permitting the string latch biasing device 84 to move the string latch 62 into the second string latch position (shown in FIG. 13). As noted above, in some embodiments, this motion of the string latch 62 may result in the operative engagement of surface 184 of the string latch 62 with surface 178 of the safety lock 136. This engagement causes the safety lock 136 and the de-cock lock 228 to pivot clockwise from their safety lock and de-cock lock first positions (shown in FIG. 24) to their safety lock and de-cock lock second positions (shown in FIG. 25). This permits the safety activator biasing device 134 to move the safety activator 132 from the second safety activator position back to the first safety activator position.

With reference now to FIGS. 1-2, 7-13 and 31, as the user continues to counter rotate handle 50 and the claw 32 and bowstring 18 continue moving distally, the bowstring 18 may engage the de-cock link 226, as explained above, causing the de-cock link 226 to begin moving back toward the second de-cock position which simultaneously causes the dry-fire link 192 to begin moving back toward the first dry-fire link position. As the bowstring 18 moves distally out of engagement with the de-cock link 226, the dry-fire link biasing device 210 may bias the dry-fire link 192 into the first dry-fire link position simultaneously moving the de-cock link 226 into the second de-cock link position. In some embodiments, this motion of the de-cock link 226 into the second de-cock link position is limited because surface 286 of the de-cock link 226 (shown in FIG. 31) operatively engages surface 234 of the housing 70 (shown in FIG. 13). Engagement of these surfaces is shown in FIG. 11. In some embodiments, shown, surface 286 is planar and surface 234 is convex curved. In some embodiments, surface 234 is composed at least in part of an elastic material to absorb vibrations and extend wear. Once the claw 32 has moved the bowstring 18 distally to the un-cocked position, the user can remove the claw 32 and, if desired, the handle 50.

With reference now to FIGS. 7-10, 18, 21 and 24-25, if the user has moved the de-cock activator 222 from the first de-cock activator position into the second de-cock activator position but then decides not to move the bowstring 18 to the un-cocked position, the de-cock activator 222 can be reset. In one embodiment, the user can reset the de-cock activator 222 by moving the reset activator 322 from the first reset activator position to the second reset activator position overcoming the biasing force of the reset activator biasing device 324. As explained above, this motion of the reset activator 322 causes the safety lock 136 to move from the first safety lock position to the second safety lock position (overcoming the biasing force of the safety lock biasing device 138) and simultaneously causes the de-cock lock 228 to move from the first de-cock lock position to the second de-cock lock position (overcoming the biasing force of the de-cock lock biasing device 230). This permits the safety activator biasing device 134 to move the safety activator 132 from the second safety activator position back to the first safety activator position and simultaneously permits the de-cock activator biasing device 224 to move the de-cock activator 222 from the second de-cock activator position back to the first de-cock activator position. When the user releases the reset activator 322, the reset activator biasing device 324 moves the reset activator 322 from the second reset activator position back to the first reset activator position.

With reference now to FIGS. 7-10, 16-17, 22, 24-25 and 33-34, in some embodiments, whenever the trigger link 64 is in the second trigger link position, the reset activator 322 may be prevented from being moved into the second reset activator position. Thus, the reset activator 322 may be prevented from accessing the safety lock 136 or the de-cock lock 228. This prevention may be accomplished because any attempt to move the reset activator 322 from the first reset activator position to the second reset activator position is prevented when surface 350 of the reset activator 322 (shown in FIGS. 33-34) operatively engages surface 158 of the trigger link 64 (shown in FIG. 16). The proximity of surfaces 350 and 158 are visible in FIG. 11. As a result, the safety activator 132 and de-cock activator 222 can only be reset when the trigger link 64 is in the first trigger link position and the string latch 62 is in the first string latch position. In some embodiments, whenever the trigger link 64 is in the second trigger link position, the safety activator 132 may be prevented from being moved from the second safety activator position to the first safety activator position. This prevention may be accomplished because any attempt to move the safety activator 132 from the second safety activator position to the first safety activator position is prevented when surface 148 of the safety activator 132 (shown in FIG. 22) operatively engages surface 164 of the trigger link 64 (shown in FIG. 17). In some embodiments, shown, surfaces 148 and 164 are planar. The proximity of surfaces 148 and 164 are apparent in FIG. 7. As a result, the safety activator 132 can only be moved into the first safety activator position when the trigger link 64 is in the first trigger link position and the string latch 62 is in the first string latch position.

With reference now to FIGS. 18-22, in some embodiments, one or more visual indicators may be provided to assist the user. As discussed above, surface 160 of the safety activator 132 may be used to indicate that the safety activator 132 is in the second safety activator position when it extends through the housing 70. As also discussed above, visual indicators may be provided by having portions of components extending (or not extending) through openings in the housing 70. One or more written indications may be provided. FIG. 19, for example, shows indicator 140 serving as a label for the de-cock activator 222. In one specific embodiment, indicator 140 is "DE-COCK." FIG. 19 also shows indicator 142 serving as a label for the safety activator 132. In one specific embodiment, indicator 142 is "PUSH TO FIRE." FIG. 20 shows indicator 144 serving as a label for the safety activator 132 on the opposite side of the housing 70. In one specific embodiment, indicator 144 is "NO-PUSH." One or more image indications may be provided. FIG. 19, for example, shows indicator 146 serving as an image for the safety activator 132. In one specific embodiment, indicator 146 is an image of a hand with a finger extended toward an image of the safety activator 132. One or more size and/or shape indications may be provided. FIG. 18, for example, shows surface 150 (see FIG. 22) of the safety activator 132 having a triangular shape while surface 240 (see FIG. 30) of the de-cock activator 222 has a circular shape. Surface 150 of the safety activator 132 also has a greater area that the surface 240 of the de-cock activator 222. One or more color indications may be provided. As discussed above, surface 160 of the safety activator 132 may be colored red. Indicators 140 and 142 may be colored red and indicator 146 may be colored white. Any visual indicators chosen with the sound judgement of a person of skill in the art may be used with embodiments of this invention.

Numerous embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

We claim:

1. A crossbow comprising:

a longitudinally extending main beam;

a bow mechanism including: (1) a pair of outwardly extending bow limbs extending transversely from opposite lateral sides of the main beam; and (2) a bowstring operatively engaged to the outwardly extending bow limbs and movable from: (a) an un-cocked position; to (b) a cocked position;

a trigger mechanism including a string latch movable into: (1) a first string latch position that holds the bowstring in the cocked position; (2) a second string latch position that does not hold the bowstring in the cocked position; and (3) a third string latch position, distinct from the first and second string latch positions, that is a de-cock mode position;

a safety mechanism including a safety activator selectively movable from: (1) a first safety activator position that prevents the string latch from being moved into the second string latch position; into (2) a second safety activator position that permits the string latch to be moved into the second string latch position;

a de-cock mechanism including a de-cock activator selectively movable from: (1) a first de-cock activator position that prevents the string latch from being moved into the third string latch position; into (2) a second de-cock activator position that permits the string latch to be moved into the third string latch position; and a reset mechanism including a reset activator that is selectively movable from: (1) a first reset activator position; into (2) a second reset activator position to: (a) move the safety activator from the second safety activator position to the first safety activator position; and (b) move the de-cock activator from the second de-cock activator position to the first de-cock activator position.

2. The crossbow of claim 1 wherein:

the trigger mechanism includes a trigger link movable between: (1) a first trigger link position that retains the string latch in the first string latch position; and (2) a second trigger link position that does not retain the string latch in the first string latch position; and when the trigger link is in the second trigger link position: the trigger link prevents the reset activator from being moved into the second reset activator position.

3. The crossbow of claim 1 wherein:

the reset mechanism includes a reset activator biasing device that applies a reset activator biasing force that biases the reset activator into the first reset activator position;

the safety mechanism includes a safety activator biasing device that applies a safety activator biasing force that biases the safety activator into the first safety activator position; and the de-cock mechanism includes a de-cock activator biasing device that applies a de-cock activator biasing force that biases the de-cock activator into the first de-cock activator position.

4. The crossbow of claim 1 wherein:

the safety mechanism includes a safety lock movable between: (1) a first safety lock position that retains the safety activator in the second safety activator position; and (2) a second safety lock position that permits the safety activator to move into the first safety activator position;

the de-cock mechanism includes a de-cock lock movable between: (1) a first de-cock lock position that retains the de-cock activator in the second de-cock activator position; and (2) a second de-cock lock position that permits the de-cock activator to move into the first de-cock activator position; and when the safety lock is in the first safety lock position and the de-cock lock is in the first de-cock lock position: moving the reset activator from: (1) the first reset activator position; into (2) the second reset activator position: (a) moves the safety lock into the second safety lock position; and (b) moves the de-cock lock into the second de-cock lock position.

5. The crossbow of claim 4 wherein:

the reset mechanism includes a reset activator biasing device that applies a reset activator biasing force that biases the reset activator into the first reset activator position;

the safety mechanism includes: (1) a safety activator biasing device that applies a safety activator biasing force that biases the safety activator into the first safety activator position; and (2) a safety lock biasing device that applies a biasing force that biases the safety lock into the first safety lock position;

the de-cock mechanism includes: (1) a de-cock activator biasing device that applies a de-cock activator biasing force that biases the de-cock activator into the first de-cock activator position; and (2) a de-cock lock biasing device that applies a biasing force that biases the de-cock lock into the first de-cock lock position;

when the safety activator is in the second safety activator position, the de-cock activator is in the second de-cock activator position, the safety lock is in the first safety lock position; and the de-cock lock is in the first de-cock lock position: moving the reset activator from the first reset activator position into the second reset activator position overcomes the biasing force of the safety lock biasing device and the biasing force of the de-cock lock biasing device permitting: (1) the safety activator biasing force to move the safety activator into the first safety activator position; and (2) the de-cock activator biasing force to move the de-cock activator into the first de-cock activator position.

6. The crossbow of claim 4 wherein:

the reset mechanism includes a reset activator biasing device that applies a reset activator biasing force that biases the reset activator into the first reset activator position;

the safety mechanism includes a safety activator biasing device that applies a safety activator biasing force that biases the safety activator into the first safety activator position;

the de-cock mechanism includes a de-cock activator biasing device that applies a de-cock activator biasing force that biases the de-cock activator into the first de-cock activator position;

an interlock biasing device applies an interlock biasing force that biases the safety lock into the first safety lock position and the de-cock lock into the first de-cock lock position; and when the safety activator is in the second safety activator position, the de-cock activator is in the second de-cock activator position, the safety lock is in the first safety lock position and the de-cock lock is in the first de-cock lock position: moving the reset activator from the first reset activator position into the second reset activator position overcomes the interlock biasing force permitting: (1) the safety activator biasing force to move the safety activator into the first safety activator position; and (2) the de-cock activator biasing force to move the de-cock activator into the first de-cock activator position.

7. The crossbow of claim 4 wherein:

a surface of the safety lock operatively engages a surface of the de-cock lock; and when the safety lock is in the first safety lock position and the de-cock lock is in the first de-cock lock position: moving the reset activator from: (1) the first reset activator position; into (2) the second reset activator position simultaneously: (a) moves the safety lock into the second safety lock position; and (b) moves the de-cock lock into the second de-cock lock position.

8. The crossbow of claim 1 wherein:

the safety activator includes a surface for use by a user to manually move the safety activator from the first safety activator position into the second safety activator position;

the de-cock activator includes a surface for use by the user to manually move the de-cock activator from the first de-cock activator position into the second de-cock activator position;

the reset activator includes a surface for use by the user to manually move the reset activator from the first reset activator position into the second reset activator position; and moving the de-cock activator from the first de-cock activator position into the second de-cock activator position moves the safety activator from the first safety activator position into the second safety activator position without user contact with the surface of the safety activator.

9. The crossbow of claim 1 wherein:

the string latch is pivotal into: (1) the first string latch position; (2) the second string latch position; and (3) the third string latch position;

the safety activator is selectively linearly movable from: (1) the first safety activator position; into (2) the second safety activator position;

the de-cock activator is selectively linearly movable from: (1) the first de-cock activator position; into (2) the second de-cock activator position; and the reset activator is selectively pivotal from: (1) the first reset activator position; into (2) the second reset activator position.

10. The crossbow of claim 1 further comprising:

a housing having first, second and third openings;

wherein:

the safety activator includes a surface for use by a user to manually move the safety activator from the first safety activator position into the second safety activator position;

the de-cock activator includes a surface for use by the user to manually move the de-cock activator from the first de-cock activator position into the second de-cock activator position;

the reset activator includes a surface for use by the user to manually move the reset activator from the first reset activator position into the second reset activator position;

the surface of the safety activator extends through the first housing opening when the safety activator is in the first safety activator position;

the surface of the de-cock activator extends through the second housing opening when the de-cock activator is in the first de-cock activator position; and the surface of the reset activator extends through the third housing opening.

11. A crossbow method comprising the steps of:

A) providing a crossbow comprising:

a longitudinally extending main beam;

a bow mechanism including: (1) a pair of outwardly extending bow limbs extending transversely from opposite lateral sides of the main beam; and (2) a bowstring operatively engaged to the outwardly extending bow limbs;

a trigger mechanism including a string latch;

a safety mechanism including a safety activator;

a de-cock mechanism including a de-cock activator; and a reset mechanism including a reset activator;

B) providing the bowstring to be operable to perform the step of: moving between: (a) an un-cocked position; and (b) a cocked position;

C) providing the string latch to be operable to perform the step of: moving into: (1) a first string latch position that holds the bowstring in the cocked position; (2) a second string latch position that does not hold the bowstring in the cocked position; and (3) a third string latch position, distinct from the first and second string latch positions, that is a de-cock mode position;

D) providing the safety activator to be operable to perform the step of: moving from: (1) a first safety activator position that prevents the string latch from being moved into the second string latch position; into (2) a second safety activator position that permits the string latch to be moved into the second string latch position;

E) providing the de-cock activator to be operable to perform the step of: moving from: (1) a first de-cock activator position that prevents the string latch from being moved into the third string latch position; into (2) a second de-cock activator position that permits the string latch to be moved into the third string latch position; and F) providing the reset activator to be operable to perform the step of: moving from: (1) a first reset activator position; into (2) a second reset activator position to: (a) move the safety activator from the second safety activator position to the first safety activator position; and (b) move the de-cock activator from the second de-cock activator position to the first de-cock activator position.

12. The crossbow method of claim 11 wherein:

step C) comprises the step of: providing the string latch to be pivotal into the first, second and third string latch positions;

step D) comprises the step of: providing the safety activator to be linearly moveable from the first safety activator position into the second safety activator position;

step E) comprises the step of: providing the de-cock activator to be linearly moveable from the first de-cock activator position into the second de-cock activator position; and step F) comprises the step of: providing the reset activator to be pivotal from the first reset activator position into the second reset activator position.

13. The crossbow method of claim 11 wherein:

step A) comprises the steps of:

providing the safety mechanism with a safety lock; and providing the de-cock mechanism with a de-cock lock;

the method further comprises the steps of:

providing the safety lock to be operable to perform the step of: moving between: (1) a first safety lock position that retains the safety activator in the second safety activator position; and (2) a second safety lock position that permits the safety activator to move into the first safety activator position; and providing the de-cock lock to be operable to perform the step of: moving between: (1) a first de-cock lock position that retains the de-cock activator in the second de-cock activator position; and (2) a second de-cock lock position that permits the de-cock activator to move into the first de-cock activator position; and step F) comprises the steps of: (1) moving the safety lock into the second safety lock position; and (b) moving the de-cock lock into the second de-cock lock position.

14. The crossbow method of claim 13 wherein:

step A) comprises the steps of:

providing the safety mechanism with a safety lock biasing device that applies a biasing force that biases the safety lock into the first safety lock position; and providing the de-cock mechanism with a de-cock lock biasing device that applies a biasing force that biases the de-cock lock into the first de-cock lock position;

step F) comprises the steps of: (1) overcoming the biasing force of the safety lock biasing device and (b) overcoming the biasing force of the de-cock lock biasing device.

15. The crossbow method of claim 11 wherein:

step A) comprises the steps of:

providing the safety mechanism with a safety activator biasing device that applies a safety activator biasing force that biases the safety activator into the first safety activator position;

providing the de-cock mechanism with a de-cock activator biasing device that applies a de-cock activator biasing force that biases the de-cock activator into the first de-cock activator position; and providing the reset mechanism with a reset activator biasing device that applies a reset activator biasing force that biases the reset activator into the first reset activator position; and step D) comprises the step of: overcoming the safety activator biasing force;

step E) comprises the step of: overcoming the de-cock activator biasing force; and step F) comprises the step of: overcoming the reset activator biasing force.

16. The crossbow method of claim 11 wherein:

step A) comprises the steps of:

providing the safety activator with a surface; and providing the de-cock activator with a surface;

step E) comprises the step of: contacting the de-cock activator surface to the safety activator surface to simultaneously move the safety activator from: (1) the first safety activator position; into (2) the second safety activator position.

17. The crossbow method of claim 11 wherein:

step A) comprises the steps of:

providing the safety activator with a surface;

providing the de-cock activator with a surface;

providing the reset activator with a surface;

step D) comprises the step of: manually engaging the surface of the safety activator;

step E) comprises the step of: manually engaging the surface of the de-cock activator; and step F) comprises the step of: manually engaging the surface of the reset activator.

* * * * *